US006857414B2

(12) United States Patent
Ogawa et al.

(10) Patent No.: US 6,857,414 B2
(45) Date of Patent: Feb. 22, 2005

(54) CONTROL SYSTEM AND METHOD FOR INTERNAL COMBUSTION ENGINE

(75) Inventors: Ken Ogawa, Saitama-ken (JP); Isao Komoriya, Saitama-ken (JP); Hiroshi Tagami, Saitama-ken (JP); Masahiro Takeuchi, Saitama-ken (JP); Minoru Torii, Saitama-ken (JP); Yuji Fujiki, Saitama-ken (JP); Kunihiro Morishita, Saitama-ken (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 10/739,399

(22) Filed: Dec. 19, 2003

(65) Prior Publication Data

US 2004/0159307 A1 Aug. 19, 2004

(30) Foreign Application Priority Data

| | | |
|---|---|---|
| Dec. 20, 2002 | (JP) | 2002-371143 |
| Dec. 20, 2002 | (JP) | 2002-371144 |
| Dec. 20, 2002 | (JP) | 2002-371145 |
| Dec. 20, 2002 | (JP) | 2002-371146 |
| Dec. 20, 2002 | (JP) | 2002-371147 |

(51) Int. Cl.[7] ..... F02B 17/00
(52) U.S. Cl. ..... 123/295; 123/436; 123/478
(58) Field of Search ..... 123/295, 436, 123/478, 480, 332

(56) References Cited

U.S. PATENT DOCUMENTS

| | | | | |
|---|---|---|---|---|
| 6,267,095 | B1 * | 7/2001 | Ikeda et al. | 123/295 |
| 6,332,456 | B2 * | 12/2001 | Mashiki | 123/520 |
| 6,463,906 | B2 * | 10/2002 | Ogawa et al. | 123/295 |
| 6,513,485 | B2 * | 2/2003 | Ogawa et al. | 123/295 |
| 6,722,342 | B2 * | 4/2004 | Ogawa et al. | 123/305 |
| 2001/0025622 | A1 * | 10/2001 | Ogawa et al. | 123/305 |
| 2003/0070653 | A1 * | 4/2003 | Ogawa et al. | 123/305 |

* cited by examiner

*Primary Examiner*—John T. Kwon
(74) *Attorney, Agent, or Firm*—Arent Fox, PLLC

(57) ABSTRACT

There is provided a control system for an internal combustion engine, which is capable of matching an output torque of the engine with a demanded torque excellently when the combustion mode is switched, thereby enhancing drivability. A demanded fuel amount and a demanded torque of the engine are calculated according to detected operating conditions of the engine. A combustion mode is determined to be either the stratified combustion mode or the homogeneous combustion mode according to the demanded torque. A pre-switching demanded fuel injection time period and a pre-switching demanded torque are stored. When the combustion mode is switched, a switching-time demanded fuel amount (limit value) is calculated according to the stored pre-switching demanded fuel injection time period and pre-switching demanded torque, the current demanded torque, and an estimated combustion efficiency parameter.

4 Claims, 15 Drawing Sheets

CONTROL SYSTEM AND METHOD FOR INTERNAL COMBUSTION ENGINE

BACKGROUND OF THE INVENTION

1. Field of the Invention

The present invention relates to a control system and method for an internal combustion engine of an in-cylinder injection type, which causes the engine to operate while switching the combustion mode of the engine between a stratified combustion mode and a homogeneous combustion mode and controls a fuel injection amount based on a calculated demanded fuel amount.

2. Description of the Related Art

Conventionally, a control system of the above-mentioned kind has been disclosed e.g. in Japanese Laid-Open Patent Publication (Kokai) No. 11-50895. According to this control system, even after the combustion mode of the engine installed on a vehicle is switched from the stratified combustion mode to the homogeneous combustion mode, some of a plurality of cylinders continue stratified combustion. In this case, the fuel injection amount for the cylinders that continue stratified combustion is set to a value calculated by multiplying the fuel injection amount calculated in the immediately preceding loop, a ratio between the present and immediately preceding values of a torque correction amount set based on the rotational speed of the engine, and a ratio between the present and immediately preceding values of a basic fuel injection amount. More specifically, the torque correction amount is set to a value increased or decreased by a fixed amount depending on which is larger, the rotational speed of the engine or a traget value thereof. The basic fuel injection amount is set to a weighted average of its immediately preceding value and the current provisional value calculated based on the amount of intake air supplied to the engine and the rotational speed of the engine. By the calculation described above, the fuel injection amount is controlled such that changes in the rotation speed of the engine and the amount of intake air are reflected therein, and at the same time an operation load on the control system is reduced.

However, the conventional control system described above suffers from the following problems: In the above method of calculating the fuel injection amount, when the combustion mode is switched, the fuel injection amount is calculated based on the immediately preceding value thereof, i.e. by multiplying the immediately preceding value by the ratio between the current and immediately preceding values of the torque correction amount and the ratio between the current and immediately preceding values of the basic fuel injection amount. However, since the torque correction amount is merely increased or decreased by the fixed amount depending on which is larger, the rotational speed of the engine speed or the target value thereof, as described above, the ratio between the current and immediately preceding values of the torque correction amount does not correctly reflect a change in torque demanded of the engine dependent on a change in the rotational speed of the engine. Further, since the basic fuel injection amount is a weighted average of the immediately preceding value and the current provisional value set according to the amount of intake air and the rotational speed of the engine, in short, an avaraged value, the ratio between the current and immediately preceding values of the basic fuel injection amount do not correctly reflect a change in the torque based on the amount of intake air and the rotational speed of the engine, either.

Therefore, the output torque of the engine obtained from the fuel injection amount calculated based on these parameters fails to agree with the demanded torque, which causes degradation of drivability.

In the above-described engine, assuming that fuel cut-off operation was exeucted in parallel with switching of the combustion mode, and that after termination of the fuel cut-off operation, the vehicle is attempted to be accelerated, the immediately preceding value of the fuel injection amount is set to 0 due to the fuel cut-off operation, and the fuel injection amount currently calculated as described avove and applied to the part of the cylinders also assumes a value of 0, which prevents torque from being obtained from the above-mentioned part of the cylinders, resulting in shortage of the torque of the engine as a whole.

Further, this control system provides the above-described control on the fule injection amount when the combustion mode is switched from the stratified combustion mode to the homonogeneous combustion but does not provide control when the combustion mode is switched in an opposite direction. In such a case, it is impossible to properly control the output torque, which also leads to degraded drivability.

SUMMARY OF THE INVENTION

It is a first object of the invention to provide a control system and method for an internal combustion engine, which are capable of matching the output torque of the engine with a demanded torque excellently when the combustion mode is switched, thereby enhancing drivability.

It is a second object of the invention to provide a control system and method for an internal combustion engine, which are capable of matching the output torque of the engine with a demanded torque such that the output torque excellently meets a torque demanded by the driver, when the combustion mode is switched, thereby enhancing drivability.

It is a third object of the invention to provide a control system and method for an internal combustion engine, which are capable of matching the output torque of the engine with a demanded torque excellently when the combustion mode is switched, and even when the fuel cut-off operation is executed in parallel with switching of the combustion mode, capable of properly setting the fuel injection amount upon termination of the fuel cut-off operation, thereby ensuring a sufficient torque demanded of the engine.

It is a fourth object of the invention to provide a control system and method for an internal combustion engine, which are capable of matching the output torque of the engine with a demanded torque excellently in whichever of switching patterns the combustion mode is switched, thereby enhancing drivability.

It is a fifth object of the invention to provide a control system and method for an internal combustion engine, which are capable of matching the output torque of the engine with a demanded torque excellently when the combustion mode is switched, thereby enhancing drivability, and capable of perform smooth transition to normal control of the fuel injection amount dependent on operating conditions of the engine.

To attain the first object, in a first aspect of the present invention, there is provided a control system for an internal combustion engine of an in-cylinder injection type, which causes the engine to operate while switching a combustion mode thereof between a stratified combustion mode in which stratified combustion of a mixture is carried out and a homogeneous combustion mode in which homogenous combustion of the mixture is carried out, and at the same time controls a fuel injection amount based on a demanded fuel amount which is calculated.

The control system according to the first aspect of the present invention is characterized by comprising:

operating condition-detecting means for detecting operating conditions of the engine;

demanded fuel amount-calculating means for calculating the demanded fuel amount according to the detected operating conditions of the engine;

demanded torque-calculating means for calculating a demanded torque of the engine according to the detected operating conditions of the engine;

combustion mode-determining means for determining which of the stratified combustion mode and the homogeneous combustion mode should be selected as the combustion mode, according to the calculated demanded torque;

storage means for storing the demanded fuel amount and the demanded torque both calculated immediately before the combustion mode has been switched according to the determination by the combustion mode-determining means;

combustion efficiency-estimating means for estimating combustion efficiency of the engine; and switching-time demanded fuel amount-calculating means responsive to switching of the combustion mode, for calculating a switching-time demanded fuel amount, as the demanded fuel amount, according to the stored demanded fuel amount and demanded torque, the demanded torque currently calculated by the demanded torque-calculating means, and the combustion efficiency currently estimated by the combustion efficiency-estimating means.

With the arrangement of the control system according to the first aspect of the present invention, the demanded torque is calculated according to the operating conditions of the engine, and which of the stratified combustion mode and the homogeneous combustion mode should be selected as the combustion mode is determined according to the calculated demanded torque. Further, the demanded fuel amount for the selected one of the combustion modes is calculated according to the operating conditions of the engine, and the fuel injection amount is controlled based on the calculated demanded fuel amount. When the combustion mode is switched, the switching-time demanded fuel amount is calculated as the demanded fuel amount, for the following reasons: Generally, in the stratified combustion mode, the amount of intake air is very large and combustion is carried out at a very lean air-fuel ratio, whereas in the homogeneous combustion mode, the amount of intake air is smaller than in the stratified combustion mode and combustion is carried out at a richer air-fuel ratio. When the combustion mode is switched, the amount of intake air does not change immediately but there is delay in response, so that it takes time for the amount of intake air to converge to a value suitable for a combustion mode after the switching. Therefore, when the combustion mode is switched, the demanded fuel amount calculated under such a circumstance according to the operating conditions of the engine, such as the amount of intake air, tends to largely fluctuate, which makes it difficult to match the output torque of the engine with the demanded torque. Further, with this arrangement of the control system, the switching-time demanded fuel amount is calculated according to the demanded fuel amount and the demanded torque both calculated immediately before the switching, the current demanded torque, and the current combustion efficiency. Since the switching-time demanded fuel amount is thus calculated according to the current demanded torque, it is possible to calculate the switching-time demanded fuel amount as a value in which the actual demanded torque at that time point is excellently reflected, without causing steep changes in the switching-time demanded fuel amount. Further, since the switching-time demanded fuel amount is calculated based on the demanded fuel amount and the demanded torque both calculated immediately before the switching, it is possible to attain smooth transition in the combustion mode without a large step in the torque between before and after the switching of the combustion mode. Moreover, although the combustion efficiency with respect to torque generally changes differently between the stratified combustion mode and the homogeneous combustion mode, with the above-described arrangement of the control system, the switching-time demanded fuel amount is calculated according to the current combustion efficiency, which enables the switching-time demanded fuel amount to be set to an appropriate value dependent on the actual combustion efficiency at the time point. Thus, the output torque of the engine can be excellently matched with the demanded torque when the combustion mode is switched, which makes it possible to enhance drivability.

To attain the second object, in a second aspect of the present invention, there is provided a control system for an internal combustion engine of an in-cylinder injection type, which causes the engine to operate while switching a combustion mode thereof between a stratified combustion mode in which stratified combustion of a mixture is carried out and a homogeneous combustion mode in which homogenous combustion of the mixture is carried out, and at the same time controls a fuel injection amount based on a demanded fuel amount which is calculated.

The control system according to the second aspect of the present invention is characterized by comprising:

operating condition-detecting means for detecting operating conditions of the engine;

demanded fuel amount-calculating means for calculating the demanded fuel amount according to the detected operating conditions of the engine;

demanded torque-calculating means for calculating a demanded torque of the engine according to the detected operating conditions of the engine;

combustion mode-determining means for determining which of the stratified combustion mode and the homogeneous combustion mode should be selected as the combustion mode, according to the calculated demanded torque;

storage means for storing the demanded fuel amount and the demanded torque both calculated immediately before the combustion mode has been switched according to the determination by the combustion mode-determining means;

combustion efficiency-estimating means for estimating combustion efficiency of the engine;

combustion efficiency-correcting means for correcting the estimated combustion efficiency according to a difference between the stored demanded torque and the demanded torque currently calculated by the demanded torque-calculating means; and switching-time demanded fuel amount-calculating means responsive to switching of the combustion mode, for calculating a switching-time demanded fuel amount, as the demanded fuel amount, according to the stored demanded fuel amount and demanded torque, the currently-calculated demanded torque, and the combustion efficiency currently corrected by the combustion efficiency-correcting means.

With the arrangement of the control system according to the second aspect of the present invention, the demanded torque is calculated according to the operating conditions of the engine, and which of the stratified combustion mode and the homogeneous combustion mode should be selected as the combustion mode is determined according to the calculated demanded torque. Further, the demanded fuel amount for the selected one of the combustion modes is calculated according to the operating conditions of the engine, and the fuel injection amount is controlled based on the calculated demanded fuel amount. When the combustion mode is switched, the switching-time demanded fuel amount is calculated according to the demanded fuel amount and demanded torque both calculated immediately before the switching of the combustion mode, the current demanded torque, and the currently corrected combustion efficiency, and used as the demanded fuel amount.

In general, the amount of intake air is set such that it is very large in the stratified combustion mode, and smaller in the homogeneous combustion mode than in the stratified combustion mode. As a result, when the combustion mode is switched, since the amount of intake air changes with delayed response, it takes time for the amount of intake air to converge to a value suitable for a combustion mode after the switching. Therefore, when the combustion mode is switched, the demanded fuel amount calculated under such a circumstance according to the operating conditions of the engine, such as the amount of intake air, tends to largely fluctuate, which makes it difficult to match the output torque of the engine with the demanded torque. However, with the arrangement of the control system described above, the switching-time demanded fuel amount is calculated as described above using the current demanded torque as a parameter, which makes it possible to set the switching-time demanded fuel amount as a value excellently reflecting the actual demanded torque at the time point, without causing sharp changes therein. Further, since the switching-time demanded fuel amount is calculated based on the demanded fuel amount and the demanded torque both calculated immediately before the switching, it is possible to attain smooth transition in the combustion mode without a large step in the torque between before and after the switching of the combustion mode. Furthermore, although the combustion efficiency with respect to torque generally changes differently between the stratified combustion mode and the homogeneous combustion mode, with the above-described arrangement of the control system, the switching-time demanded fuel amount is calculated according to the currently corrected combustion efficiency, which enables the switching-time demanded fuel amount to be set to an appropriate value dependent on the actual combustion efficiency at the time point. Thus, the output torque of the engine can be excellently matched with the demanded torque when the combustion mode is switched, which makes it possible to enhance drivability.

Moreover, since the combustion efficiency is corrected according to the difference between the demanded torque calculated immediately before the switching and the current demanded torque, or more specifically, according to an overall increasing or decreasing tendency of the demanded torque from immediately before the switching of the combustion mode to the present time, it is possible to set the switching-time demanded fuel amount calculated according to the corrected combustion efficiency, to a value excellently reflecting the increasing or decreasing tendency of the demanded torque, and therefore match the output torque of the engine more excellently with a torque demanded by the driver.

To attain the third object, in a third aspect of the present invention, there is provided a control system for an internal combustion engine of an in-cylinder injection type, which causes the engine to operate while switching a combustion mode thereof between a stratified combustion mode in which stratified combustion of a mixture is carried out and a homogeneous combustion mode in which homogenous combustion of the mixture is carried out, and perform fuel-cut operation depending on operating conditions of the engine, and at the same time controls a fuel injection amount based on a demanded fuel amount which is calculated.

The control system according to the third aspect of the present invention is characterized by comprising:

operating condition-detecting means for detecting the operating conditions of the engine;

demanded fuel amount-calculating means for calculating the demanded fuel amount according to the detected operating conditions of the engine;

demanded torque-calculating means for calculating a demanded torque of the engine according to the detected operating conditions of the engine;

combustion mode-determining means for determining which of the stratified combustion mode and the homogeneous combustion mode should be selected as the combustion mode, according to the calculated demanded torque;

storage means for storing the demanded fuel amount and the demanded torque both calculated immediately before the combustion mode has been switched according to the determination by the combustion mode-determining means;

combustion efficiency-estimating means for estimating combustion efficiency of the engine;

switching-time demanded fuel amount-calculating means responsive to switching of the combustion mode, for calculating a switching-time demanded fuel amount, as the demanded fuel amount, according to the stored demanded fuel amount and demanded torque, the demanded torque currently calculated by the demanded torque-calculating means, and the combustion efficiency currently estimated by the combustion efficiency-estimating means;

determination means for determining whether or not the fuel cut-off operation of the engine has been terminated; and inhibition means for inhibiting the switching-time demanded fuel amount-calculating means from calculating the switching-time demanded fuel amount, until a predetermined time elapses after it is determined by the determination means that the fuel cut-off operation of the engine has been terminated.

With the arrangement of the control system according to the third aspect of the present invention, the demanded torque is calculated according to the operating conditions of the engine, and which of the stratified combustion mode and the homogeneous combustion mode should be selected as the combustion mode is determined according to the calculated demanded torque. Further, the demanded fuel amount for the selected one of the combustion modes is calculated according to the operating conditions of the engine, and the fuel injection amount is controlled based on the calculated demanded fuel amount. When the combustion mode is switched, the switching-time demanded fuel amount is calculated according to the demanded fuel amount and demanded torque both calculated immediately before the switching of the combustion mode, the current demanded torque, and the current combustion efficiency, and used as the demanded fuel amount.

In general, the amount of intake air is set such that it is very large in the stratified combustion mode, and smaller in the homogeneous combustion mode than in the stratified combustion mode. As a result, when the combustion mode is switched, since the amount of intake air changes with delayed response, it takes time for the amount of intake air to converge to a value suitable for a combustion mode after the switching. Therefore, when the combustion mode is switched, if the demanded fuel amount is calculated under such a circumstance according to the operating conditions of the engine, such as the amount of intake air, the output torque of the engine becomes difficult to match the demanded torque. However, with the above-described arrangement of the control system, the switching-time demanded fuel amount is calculated as described above using the current demanded torque as a parameter, which makes it possible to set the switching-time demanded fuel amount as a value excellently reflecting the actual demanded torque at the time point, without causing sharp changes therein. Further, since the switching-time demanded fuel amount is calculated based on the demanded fuel amount and the demanded torque both calculated immediately before the switching, it is possible to attain smooth transition in the combustion mode without a large step in the torque between before and after the switching of the combustion mode. Furthermore, although the combustion efficiency with respect to torque generally changes differently between the stratified combustion mode and the homogeneous combustion mode, with the above-described arrangement of the control system, the switching-time demanded fuel amount is calculated according to the current combustion efficiency, which enables the switching-time demanded fuel amount to be set to an appropriate value dependent on the actual combustion efficiency at the time point. Thus, the output torque of the engine can be excellently matched with the demanded torque when the combustion mode is switched, which makes it possible to enhance drivability.

Moreover, when the fuel cut-off operation is performed in parallel with the switching of the combustion mode, the calculation of the switching-time demanded fuel amount is inhibited until a predetermined time elapses after termination of the fuel cut-off operation of the engine. This makes it possible to properly set the current demanded fuel amount without calculating the same as too small a value based on the demanded fuel amount immediately before the switching which is set to a value of 0, thereby ensuring that a sufficient torque is produced by the engine as a whole.

To attain the fourth object, in a fourth aspect of the present invention, there is provided a control system for an internal combustion engine of an in-cylinder injection type, which causes the engine to operate while switching a combustion mode thereof between a stratified combustion mode in which stratified combustion of a mixture is carried out and a homogeneous combustion mode in which homogenous combustion of the mixture is carried out, and at the same time controls a fuel injection amount based on a demanded fuel amount which is calculated.

The control system according to the fourth aspect of the present invention is characterized by comprising:

operating condition-detecting means for detecting operating conditions of the engine;

demanded fuel amount-calculating means for calculating the demanded fuel amount according to the detected operating conditions of the engine;

demanded torque-calculating means for calculating a demanded torque of the engine according to the detected operating conditions of the engine;

combustion mode-determining means for determining which of the stratified combustion mode and the homogeneous combustion mode should be selected as the combustion mode, according to the calculated demanded torque;

storage means for storing the demanded fuel amount and the demanded torque both calculated immediately before the combustion mode has been switched according to the determination by the combustion mode-determining means;

first combustion efficiency-estimating means for estimating a first combustion efficiency of the engine for use in a first switching pattern in which the combustion mode is switched from the stratified combustion mode to the homogeneous combustion mode;

second combustion efficiency-estimating means for estimating a second combustion efficiency of the engine for use in a second switching pattern in which the combustion mode is switched from the homogeneous combustion mode to the stratified combustion mode; and switching-time demanded fuel amount-calculating means responsive to switching of the combustion mode, for calculating a switching-time demanded fuel amount, as the demanded fuel amount, according to the stored demanded fuel amount and demanded torque, the demanded torque currently calculated by the demanded torque-calculating means, and one of the first combustion efficiency and the second combustion efficiency corresponding to one of the first switching pattern and the second switching pattern according to which the switching of the combustion mode has been currently performed.

With the arrangement of the control system according to the fourth aspect of the present invention, the demanded torque is calculated according to the operating conditions of the engine, and which of the stratified combustion mode and the homogeneous combustion mode should be selected as the combustion mode is determined according to the calculated demanded torque. Further, the demanded fuel amount for the selected one of the combustion modes is calculated according to the operating conditions of the engine, and the fuel injection amount is controlled based on the calculated demanded fuel amount. When the combustion mode is switched, the switching-time demanded fuel amount is calculated according to the demanded fuel amount and demanded torque both calculated immediately before the switching of the combustion mode, the current demanded torque, and the current combustion efficiency, and used as the demanded fuel amount.

In general, the amount of intake air is set such that it is very large in the stratified combustion mode, and smaller in the homogeneous combustion mode than in the stratified combustion mode. As a result, when the combustion mode is switched, since the amount of intake air changes with delayed response, it takes time for the amount of intake air to converge to a value suitable for a combustion mode after the switching. Therefore, when the combustion mode is switched, if the demanded fuel amount is calculated under such a circumstance according to the operating conditions of the engine, such as the amount of intake air, the output torque of the engine becomes difficult to match the demanded torque. However, with the above-described arrangement of the control system, the switching-time demanded fuel amount is calculated as described above using the current demanded torque as a parameter, which makes it possible to set the switching-time demanded fuel amount as a value excellently reflecting the actual demanded torque at the time point, without causing sharp changes therein. Further, since the switching-time demanded fuel amount is calculated based on the demanded fuel amount and the demanded torque both calculated immediately before the switching, it is possible to attain smooth transition in the combustion mode without a large step in the torque between before and after the switching of the combustion mode. Furthermore, since the switching-time demanded fuel amount is calculated according to the current combustion efficiency, which enables the switching-time demanded fuel amount to be set to an appropriate value dependent on the actual combustion efficiency at the time point. Thus, the output torque of the engine can be excellently matched with the demanded torque when the combustion mode is switched, which makes it possible to enhance drivability.

Moreover, according to the fourth aspect of the present invention, there are separately estimated a first combustion efficiency of the engine for use in a first switching pattern in which the combustion mode is switched from the stratified combustion mode to the homogeneous combustion mode and a second combustion efficiency of the engine for use in a second switching pattern in which the combustion mode is switched from the homogeneous combustion mode to the stratified combustion mode, and in calculation of the switching-time demanded fuel amount, there is employed one of the first combustion efficiency and the second combustion efficiency corresponding to one of the first switching pattern and the second switching pattern according to which the switching of the combustion mode has been currently performed. In general, in a low-load region in which the switching of the combustion mode is performed, the combustion efficiency tends to decrease when the combustion mode is switched from the stratified combustion mode to the homogeneous combustion mode, and tends to increase when the switching is performed in an opposite direction. Therefore, by using one of the first combustion efficiency and the second combustion efficiency corresponding to one of the switching patterns according to which the current switching of the combustion mode has been performed, it is possible to set the switching-time demanded fuel amount to an optimal value dependent on the actual combustion efficiency at the time, in whichever of the switching patters the switching of the combustion mode may be performed, whereby the output torque of the engine can be more excellently matched with the demanded torque.

To attain the fifth object, in a fifth aspect of the present invention, there is provided a control system for an internal combustion engine of an in-cylinder injection type, which causes the engine to operate while switching a combustion mode thereof between a stratified combustion mode in which stratified combustion of a mixture is carried out and a homogeneous combustion mode in which homogenous combustion of the mixture is carried out, and at the same time controls a fuel injection amount based on a demanded fuel amount which is calculated.

The control system according to the fifth aspect of the present invention is characterized by comprising:

operating condition-detecting means for detecting operating conditions of the engine;

normal-time demanded fuel amount-calculating means for calculating a normal-time demanded fuel amount as the demanded fuel amount, according to the detected operating conditions of the engine;

demanded torque-calculating means for calculating a demanded torque of the engine according to the detected operating conditions of the engine;

combustion mode-determining means for determining which of the stratified combustion mode and the homogeneous combustion mode should be selected as the combustion mode, according to the calculated demanded torque;

storage means for storing the demanded fuel amount and the demanded torque both calculated immediately before the combustion mode has been switched according to the determination by the combustion mode-determining means;

combustion efficiency-estimating means for estimating combustion efficiency of the engine; and switching-time demanded fuel amount-calculating means responsive to switching of the combustion mode, for calculating a switching-time demanded fuel amount as the demanded fuel amount, in order to carry out limitation of the normal-time demanded fuel amount, according to the stored demanded fuel amount and demanded torque, the demanded torque currently calculated by the demanded torque-calculating means, and the combustion efficiency currently estimated by the combustion efficiency-estimating means;

comparison means for comparing the normal-time demanded fuel amount and the switching-time demanded fuel amount with each other; and first limitation-terminating means responsive to the comparison by the comparison means, for terminating the limitation of the normal-time demanded fuel amount by the switching-time demanded fuel amount, when a relation which the switching-time demanded fuel amount has in respect of magnitude with the normal-time demanded fuel amount becomes opposite to a direction of the limitation of the normal-time demanded fuel amount.

With the arrangement of the control system according to the fifth aspect of the present invention, the demanded torque is calculated according to the operating conditions of the engine, and which of the stratified combustion mode and the homogeneous combustion mode should be selected as the combustion mode is determined according to the calculated demanded torque. Further, as the demanded fuel amount for the selected one of the combustion modes, the normal-time demanded fuel amount is calculated according to the operating conditions of the engine, and the fuel injection amount is controlled based on the calculated demanded fuel amount. When the combustion mode is switched, the switching-time demanded fuel amount is calculated, in order to perform limitation of the normal-time demanded fuel amount, according to the demanded fuel amount and demanded torque both calculated immediately before the switching of the combustion mode, the current demanded torque, and the current combustion efficiency, and used as the demanded fuel amount.

In general, the amount of intake air is set such that it is very large in the stratified combustion mode, and smaller in the homogeneous combustion mode than in the stratified combustion mode. As a result, when the combustion mode is switched, since the amount of intake air changes with delayed response, it takes time for the amount of intake air to converge to a value suitable for a combustion mode after the switching. Therefore, when the combustion mode is switched, if the normal-time demanded fuel amount is calculated under such a circumstance according to the operating conditions of the engine, such as the amount of intake air, the calculated normal-time demanded fuel amount tends to increase sharply when the combustion mode is switched from the stratified combustion mode to the homogeneous combustion mode, and tends to decrease sharply when the combustion mode is switched in an opposite direction to the above, which makes the output torque of the engine difficult to match the demanded torque. The present invention is directed to calculating the switching-time demanded fuel amount with a view to limiting the normal-time demanded fuel amount which tends to increase or decrease sharply when the combustion mode is switched. More specifically, the switching-time demanded fuel amount is calculated as described above using the current demanded torque as a parameter, which makes it possible to set the switching-time demanded fuel amount as a value excellently reflecting the actual demanded torque at the time point, without causing sharp changes therein. Further, since the switching-time demanded fuel amount is calculated based on the demanded fuel amount and the demanded torque both calculated immediately before the switching, it is possible to attain smooth transition in the combustion mode without a large step in the torque between before and after the switching of the combustion mode. Furthermore, although the combustion efficiency with respect to torque generally changes differently between the stratified combustion mode and the homogeneous combustion mode, with the above-described arrangement of the control system, the switching-time demanded fuel amount is calculated according to the current combustion efficiency, which enables the switching-time demanded fuel amount to be set to an appropriate value dependent on the actual combustion efficiency at the time point. Thus, the output torque of the engine can be excellently matched with the demanded torque when the combustion mode is switched, which makes it possible to enhance drivability.

Moreover, with the arrangement of the fifth aspect of the present invention, the limitation of the normal-time demanded fuel amount by the switching-time demanded fuel amount is terminated when a relation which the switching-time demanded fuel amount has in respect of magnitude with the normal-time demanded fuel amount becomes opposite to a direction of the limitation of the normal-time demanded fuel amount. For example, when the combustion mode is switched from the stratified combustion mode to the homogeneous combustion mode, the limitation using the switching-time demanded fuel amount is terminated if the switching-time demanded fuel amount which should limit the normal-time demanded fuel amount in a decreasing direction (i.e. such that the demanded fuel amount is decreased) becomes larger than the normal-time demanded fuel amount, and when the combustion mode is switched from the homogeneous combustion mode to the stratified combustion mode, the limitation using the switching-time demanded fuel amount is terminated if the switching-time demanded fuel amount which should limit the normal-time demanded fuel amount in an increasing direction (i.e. such that the demanded fuel amount is increased) becomes smaller than the normal-time demanded fuel amount. This causes the limitation using the switching-time demanded fuel to be terminated instantly when it becomes unnecessary to execute, which enables swift transition to the normal fuel injection control according to the operating conditions of the engine, such as the amount of intake air.

Preferably, the control system further comprises second limitation-terminating means for terminating the limitation by the switching-time demanded fuel amount, when a predetermined time period has elapsed after the switching of the combustion mode.

During the execution of the limitation of the fuel amount using the switching-time demanded fuel amount, the aforementioned relation is sometimes difficult to become opposite to the direction of the limitation. However, with the arrangement of this preferred embodiment, when the predetermined period elapses, the limitation using the switching-time demanded fuel amount is forcibly terminated by the second limitation-terminating means, which enables the positive transition to the normal fuel injection control while preventing the limitation from being executed for an unnecessarily long time.

To attain the second object, in a sixth aspect of the present invention, there is provided a control method for an internal combustion engine of an in-cylinder injection type, which causes the engine to operate while switching a combustion mode thereof between a stratified combustion mode in which stratified combustion of a mixture is carried out and a homogeneous combustion mode in which homogenous combustion of the mixture is carried out, and at the same time controls a fuel injection amount based on a demanded fuel amount which is calculated.

The control method according to the sixth aspect of the present invention is characterized by comprising:

an operating condition-detecting step of detecting operating conditions of the engine;

a demanded fuel amount-calculating step of calculating the demanded fuel amount according to the detected operating conditions of the engine;

a demanded torque-calculating step of calculating a demanded torque of the engine according to the detected operating conditions of the engine;

a combustion mode-determining step of determining which of the stratified combustion mode and the homogeneous combustion mode should be selected as the combustion mode, according to the calculated demanded torque;

a storing step of storing the demanded fuel amount and the demanded torque both calculated immediately before the combustion mode has been switched according to the determination in the combustion mode-determining step;

a combustion efficiency-estimating step of estimating combustion efficiency of the engine; and a switching-time demanded fuel amount-calculating step of calculating a switching-time demanded fuel amount upon switching of the combustion mode, as the demanded fuel amount, according to the stored demanded fuel amount and demanded torque, the demanded torque currently calculated in the demanded torque-calculating step, and the combustion efficiency currently estimated in the combustion efficiency-estimating step.

With the arrangement of the control method according to the sixth aspect of the present invention, it is possible to obtain the same advantageous effects as provided by the fifth aspect of the present invention.

To attain the second object, in a seventh aspect of the present invention, there is provided a control method for an internal combustion engine of an in-cylinder injection type, which causes the engine to operate while switching a combustion mode thereof between a stratified combustion mode in which stratified combustion of a mixture is carried out and a homogeneous combustion mode in which homogenous combustion of the mixture is carried out, and at the same time controls a fuel injection amount based on a demanded fuel amount which is calculated.

The control method according to the seventh aspect of the present invention is characterized by comprising:

an operating condition-detecting step of detecting operating conditions of the engine;

a demanded fuel amount-calculating step of calculating the demanded fuel amount according to the detected operating conditions of the engine;

a demanded torque-calculating step of calculating a demanded torque of the engine according to the detected operating conditions of the engine;

a combustion mode-determining step of determining which of the stratified combustion mode and the homogeneous combustion mode should be selected as the combustion mode, according to the calculated demanded torque;

a storing step of storing the demanded fuel amount and the demanded torque both calculated immediately before the combustion mode has been switched according to the determination in the combustion mode-determining step;

a combustion efficiency-estimating step of estimating combustion efficiency of the engine;

a combustion efficiency-correcting step of correcting the estimated combustion efficiency according to a difference between the stored demanded torque and the demanded torque currently calculated in the demanded torque-calculating step; and a switching-time demanded fuel amount-calculating step of calculating a switching-time demanded fuel amount upon switching of the combustion mode, as the demanded fuel amount, according to the stored demanded fuel amount and demanded torque, the currently-calculated demanded torque, and the combustion efficiency currently corrected in the combustion efficiency-correcting step.

With the arrangement of the control method according to the seventh aspect of the present invention, it is possible to obtain the same advantageous effects as provided by the second aspect of the present invention.

To attain the second object, in an eighth aspect of the present invention, there is provided a control method for an internal combustion engine of an in-cylinder injection type, which causes the engine to operate while switching a combustion mode thereof between a stratified combustion mode in which stratified combustion of a mixture is carried out and a homogeneous combustion mode in which homogenous combustion of the mixture is carried out, and perform fuel-cut operation depending on operating conditions of the engine, and at the same time controls a fuel injection amount based on a demanded fuel amount which is calculated.

The control method according to the eighth aspect of the present invention is characterized by comprising:

an operating condition-detecting step of detecting the operating conditions of the engine;

a demanded fuel amount-calculating step of calculating the demanded fuel amount according to the detected operating conditions of the engine;

a demanded torque-calculating step of calculating a demanded torque of the engine according to the detected operating conditions of the engine;

a combustion mode-determining step of determining which of the stratified combustion mode and the homogeneous combustion mode should be selected as the combustion mode, according to the calculated demanded torque;

a storing step of storing the demanded fuel amount and the demanded torque both calculated immediately before the combustion mode has been switched according to the determination in the combustion mode-determining step;

a combustion efficiency-estimating step of estimating combustion efficiency of the engine;

a switching-time demanded fuel amount-calculating step of calculating a switching-time demanded fuel amount upon switching of the combustion mode, as the demanded fuel amount, according to the stored demanded fuel amount and demanded torque, the demanded torque currently calculated in the demanded torque-calculating step, and the combustion efficiency currently estimated in the combustion efficiency-estimating step;

a determining step of determining whether or not the fuel cut-off operation of the engine has been terminated; and an inhibiting step of inhibiting calculation of the switching-time demanded fuel amount in the switching-time demanded fuel amount-calculating step, until a predetermined time elapses after it is determined in the determining step that the fuel cut-off operation of the engine has been terminated.

With the arrangement of the control method according to the eighth aspect of the present invention, it is possible to obtain the same advantageous effects as provided by the third aspect of the present invention.

To attain the second object, in a ninth aspect of the present invention, there is provided a control method for an internal combustion engine of an in-cylinder injection type, which causes the engine to operate while switching a combustion mode thereof between a stratified combustion mode in which stratified combustion of a mixture is carried out and a homogeneous combustion mode in which homogenous combustion of the mixture is carried out, and at the same time controls a fuel injection amount based on a demanded fuel amount which is calculated.

The control method according to the ninth aspect of the present invention is characterized by comprising:

an operating condition-detecting step of detecting operating conditions of the engine;

a demanded fuel amount-calculating step of calculating the demanded fuel amount according to the detected operating conditions of the engine;

a demanded torque-calculating step of calculating a demanded torque of the engine according to the detected operating conditions of the engine;

a combustion mode-determining step of determining which of the stratified combustion mode and the homogeneous combustion mode should be selected as the combustion mode, according to the calculated demanded torque;

a storing step of storing the demanded fuel amount and the demanded torque both calculated immediately before the combustion mode has been switched according to the determination in the combustion mode-determining step;

a first combustion efficiency-estimating step of estimating a first combustion efficiency of the engine for use in a first switching pattern in which the combustion mode is switched from the stratified combustion mode to the homogeneous combustion mode;

a second combustion efficiency-estimating step of estimating a second combustion efficiency of the engine for use in a second switching pattern in which the combustion mode is switched from the homogeneous combustion mode to the stratified combustion mode; and a switching-time demanded fuel amount-calculating step of calculating a switching-time demanded fuel amount upon switching of the combustion mode, as the demanded fuel amount, according to the stored demanded fuel amount and demanded torque, the demanded torque currently calculated in the demanded torque-calculating step, and one of the first combustion efficiency and the second combustion efficiency corresponding to one of the first switching pattern and the second switching pattern according to which the switching of the combustion mode has been currently performed.

With the arrangement of the control method according to the ninth aspect of the present invention, it is possible to obtain the same advantageous effects as provided by the fourth aspect of the present invention.

To attain the fifth object, in a tenth aspect of the present invention, there is provided a control method for an internal combustion engine of an in-cylinder injection type, which causes the engine to operate while switching a combustion mode thereof between a stratified combustion mode in which stratified combustion of a mixture is carried out and a homogeneous combustion mode in which homogenous combustion of the mixture is carried out, and at the same time controls a fuel injection amount based on a demanded fuel amount which is calculated.

The control method according to the tenth aspect of the present invention is characterized by comprising:

an operating condition-detecting step of detecting operating conditions of the engine;

a normal-time demanded fuel amount-calculating step of calculating a normal-time demanded fuel amount as the demanded fuel amount, according to the detected operating conditions of the engine;

a demanded torque-calculating step of calculating a demanded torque of the engine according to the detected operating conditions of the engine;

a combustion mode-determining step of determining which of the stratified combustion mode and the homogeneous combustion mode should be selected as the combustion mode, according to the calculated demanded torque;

a storing step of storing the demanded fuel amount and the demanded torque both calculated immediately before the combustion mode has been switched according to the determination in the combustion mode-determining step;

a combustion efficiency-estimating step of estimating combustion efficiency of the engine; and a switching-time demanded fuel amount-calculating step of calculating a switching-time demanded fuel amount upon switching of the combustion mode, as the demanded fuel amount, in order to carry out limitation of the normal-time demanded fuel amount, according to the stored demanded fuel amount and demanded torque, the demanded torque currently calculated in the demanded torque-calculating step, and the combustion efficiency currently estimated in the combustion efficiency-estimating step;

a comparison step of comparing the normal-time demanded fuel amount and the switching-time demanded fuel amount with each other; and a first limitation-terminating step of terminating the limitation of the normal-time demanded fuel amount by the switching-time demanded fuel amount in response to the comparison in the comparison step, when a relation which the switching-time demanded fuel amount has in respect of magnitude with the normal-time demanded fuel amount becomes opposite to a direction of the limitation of the normal-time demanded fuel amount.

With the arrangement of the control method according to the tenth aspect of the present invention, it is possible to obtain the same advantageous effects as provided by the fifth aspect of the present invention.

Preferably, the control method further comprises a second limitation-terminating step of terminating the limitation by the switching-time demanded fuel amount, when a predetermined time period has elapsed after the switching of the combustion mode.

With the arrangement of the preferred embodiment, it is possible to obtain the same advantageous effects as provided by the corresponding preferred embodiment of the fifth aspect of the present invention.

The above and other objects, features, and advantages of the invention will become more apparent from the following detailed description taken in conjunction with the accompanying drawings.

DETAILED DESCRIPTION OF PREFERRED EMBODIMENTS

Figure 1:
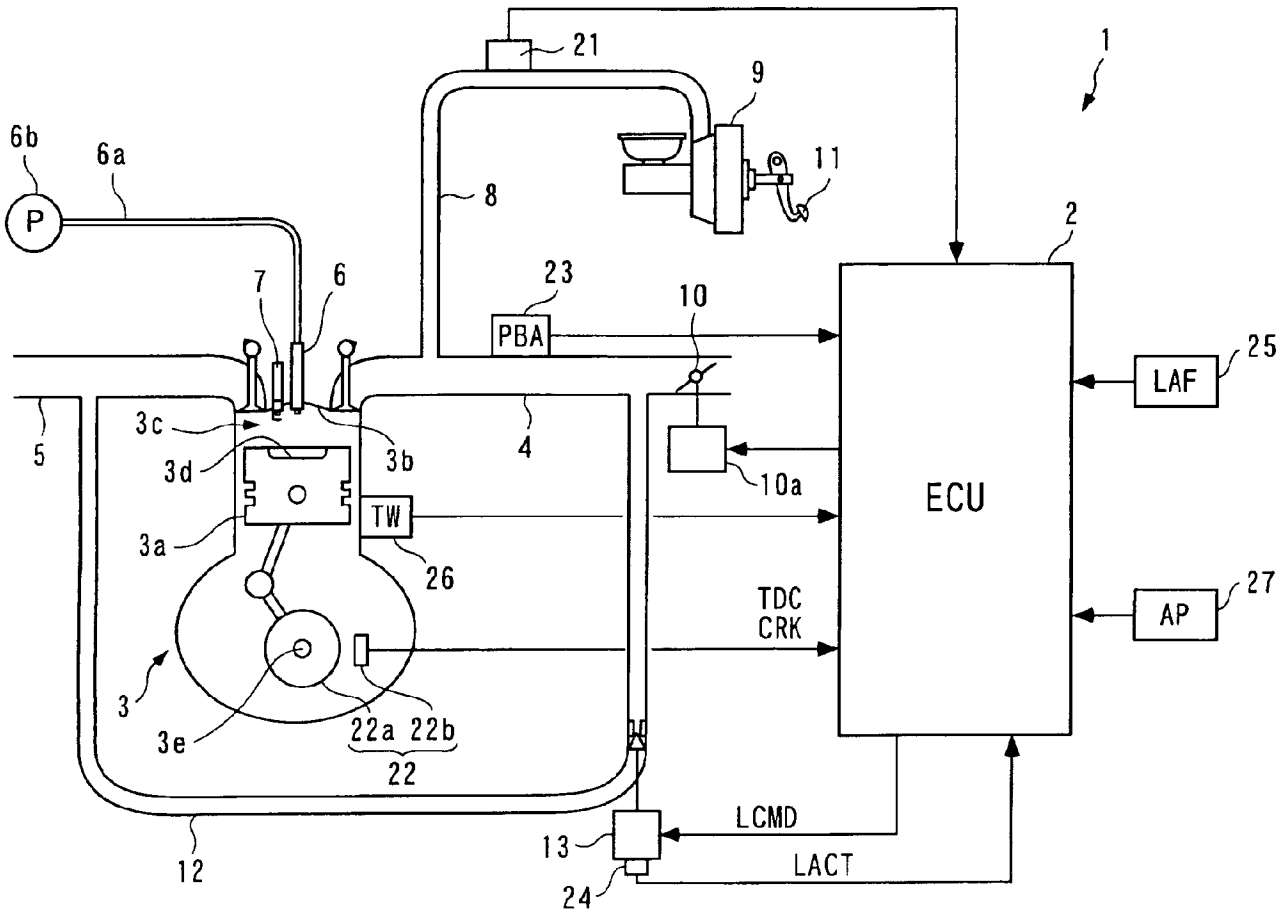
FIG. 1 is a block diagram schematically showing the arrangement of a control system according to an embodiment of the present invention and an internal combustion engine to which the control system is applied.

The present invention will now be described in detail with reference to the drawings showing a preferred embodiment thereof. FIG. 1 schematically shows the arrangement of a control system 1 according to the embodiment of the present invention and an internal combustion engine 3 (hereinafter simply referred to as "the engine 3") to which the control system 1 is applied. The control system 1 includes an ECU 2.

The engine 3 is a straight type four-cylinder gasoline engine for a vehicle, not shown. The engine 3 has four cylinders (only one of which is shown) in each of which a combustion chamber 3*c* is defined between a piston 3*a* and a cylinder head 3*b*. The piston 3*a* has a central portion of a top surface thereof formed with a recess 3*d*. The cylinder head 3*b* has an air intake pipe 4 and an exhaust pipe 5 extending therefrom, as well as a fuel injection valve 6 (hereinafter simply referred to as "the injector 6") and a spark plug 7 inserted therein in a manner facing each combustion chamber 3*c*. The engine 3 is a so-called in-cylinder fuel injection type that injects fuel directly into the combustion chamber 3*c* by the injector 6.

The injector 6 is inserted through the central portion of the top wall of the combustion chamber 3*c* and connected to a fuel pump 6*b* via a fuel pipe 6*a*. Fuel is supplied from a fuel tank, not shown, to the injector 6, after being pressurized by the fuel pump 6*b* to a high level, and having the pressure thereof regulated by a regulator, not shown. The fuel is injected from the injector 6 toward the recess 3*d* of the piston 3*a*, and hits the top surface of the piston 3*a* including the recess 3*d*, to form fuel jets. Particularly in a stratified combustion mode described in detail hereinafter, most of the fuel injected from the injector 6 hits the recess 3*d* to form fuel jets.

Connected to the intake pipe 4 is a brake booster 9 via a branch pipe 8. The brake booster 9 is formed e.g. of a circular rubber diaphragm. The brake booster 9 is supplied with negative pressure generated by closing of throttle valve 10. The negative pressure within the brake booster 9 amplifies the force applied to a brake pedal 11 by the driver stepping thereon. A negative pressure sensor 21 is provided in communication with the inside of the branch pipe 8. The negative pressure sensor 21 detects the negative pressure supplied to the brake booster 9 and delivers a signal indicative of the sensed negative pressure to the ECU2.

The throttle valve 10 is connected to an electric motor 10*a*, which is connected to the ECU2. The ECU2 controls the amount of intake air (hereinafter referred to as "the intake air amount") for the engine 3 by controlling the degree of opening of the throttle valve 10 via an electric motor 10*a*, according to the operating conditions of the engine 3.

The engine 3 has a crankshaft 3*e* around which a crank angle position sensor 22 (operating condition-detecting means) is disposed. The crank angle position sensor 22 is comprised of a magnet rotor 22*a* and an MRE (magnetic resistance element) pickup 22*b*. The crank angle position sensor 22 delivers a CRK signal and a TDC signal, which are both pulse signals, in accordance with rotation of the crankshaft 3*e*.

Each pulse of the CRK signal is generated whenever the crankshaft 3*e* rotates through a predetermined angle (e.g. 30 degrees). The ECU 2 determines a rotational speed (hereinafter referred to as "the engine speed") NE of the engine 3, based on the CRK signal. The TDC signal indicates that each piston 3*a* in an associated cylinder is in a predetermined crank angle position immediately before the TDC (top dead center) position at the start of an intake stroke, and each pulse of the TDC signal is generated whenever the crankshaft 3*e* rotates through 180 degrees in the case of the four-cylinder engine 3 according to the present embodiment. Further, the engine 3 is provided with a cylinder-discriminating sensor, not shown. The cylinder-discriminating sensor generates a cylinder-discriminating signal, which is a pulse signal for discriminating each cylinder from the others, to deliver the signal to the ECU 2. The ECU 2 determines the respective crank angle positions of the cylinders on a cylinder-by-cylinder basis, based on these CRK and TDC signals.

Further, an intake pipe absolute pressure sensor 23 (operating condition-detecting means) is disposed at a location downstream of the throttle valve 10 in communication with the inside of the intake pipe 4. The intake pipe absolute pressure sensor 23 detects an intake pipe absolute pressure PBA within the intake pipe 4 to deliver an electric signal indicative of the sensed intake pipe absolute pressure to the ECU 2.

An EGR pipe 12 extends to connect between a portion of the intake pipe 4 downstream of the throttle valve 10 and a portion of the exhaust pipe 5 upstream of a catalytic device, not shown. Exhaust gases emitted from the engine 3 are recirculated toward the intake side of the engine 3 through the EGR pipe 12 to lower a combustion temperature within the combustion chamber 3*c*, whereby EGR operation is carried out to reduce NOx contained in the exhaust gases.

The EGR pipe 12 has an EGR control valve 13 mounted therein. The EGR control valve 13 is connected, via a spring (not shown), to a rotor of a stepper motor (not shown). The EGR pipe 12 is opened and closed by controlling the operation of the stepper motor by a drive signal from the ECU2 to thereby change a valve lift amount LACT of the EGR control valve. The valve lift amount LACT is detected by a valve lift sensor 24, and a signal indicative of the sensed valve lift LACT is delivered to the ECU 2.

The ECU 2 calculates a target valve lift amount LCMD of the EGR control valve 13 according to the operating conditions of the engine 3 and controls the EGR control valve 13 such that the actual valve lift amount LACT becomes equal to the target valve lift amount LCMD, to thereby control the EGR rate.

A LAF sensor 25 is disposed in the exhaust pipe 5 at a location upstream of the catalytic device. The LAF sensor 25 linearly detects the concentration of oxygen in exhaust gases in a broad air-fuel ratio range from a rich region richer than the stoichiometric ratio to a very lean region, to deliver an output KACT proportional to the sensed oxygen concentration to the ECU 2.

The ECU 2 receives a signal indicative of a temperature TW of an engine coolant circulating through the cylinder block of the engine 3 (hereinafter referred to as "the engine coolant temperature TW") from an engine coolant temperature sensor 26, and a signal indicative of the degree of opening or stepped-on amount AP of an accelerator pedal, not shown, (hereinafter referred to as "the accelerator opening") from an accelerator opening sensor 27 (operating condition-detecting means).

The ECU 2 is implemented by a microcomputer comprised of an I/O interface, a CPU, a RAM, and a ROM. The signals from the aforementioned sensors 21 to 27 are input to the CPU after the I/O interface performs A/D conversion and waveform shaping thereon. Based on these input signals, in accordance with control programs read from the ROM, the CPU carries out fuel cut-off (hereinafter referred to as "F/C") operation of the engine 3, and calculates a demanded torque PMCMDREG as described in detail hereinafter. Further, the CPU determines a combustion mode of the engine 3 based on the demanded torque PMCMDREG, and according to the determined combustion mode, controls a fuel injection time period over which the injector 6 is open for fuel injection as well as ignition timing of the spark plug 7. The fuel injection time period is controlled based on a demanded fuel injection time period TCYLBS (demanded fuel amount) calculated as described hereinafter. In the present embodiment, the ECU 2 forms operating condition-detecting means, demanded fuel amount-calculating means, demanded torque-calculating means, combustion mode-determining means, storage means, combustion efficiency-estimating means, first combustion efficiency-estimating means, second combustion efficiency-estimating means, combustion efficiency-correcting means, switching-time demanded fuel amount-calculating means, comparison means, first limitation-terminating means, second limitation-terminating means, determination means, and inhibition means.

The combustion mode mentioned above is switched to the stratified combustion mode for very low-load operation such as idling, and to a homogeneous combustion mode for operations other than the very low-load operation. During mode transition between these combustion modes, a double-injection mode is executed.

In the stratified combustion mode, fuel is injected into the combustion chamber 3*c* from the injector 6 during a compression stroke, and most of the injected fuel is caused to hit the recess 3*d* to form fuel jets. The fuel jets and a flow of air taken in from the intake pipe 4 form an air-fuel mixture. At this time, the piston 3*a* in the compression stroke is near the top dead center position, which causes the air-fuel mixture to be unevenly distributed in the combustion chamber i.e. concentrated in the vicinity of the spark plug 7, whereby the mixture is burned by stratified combustion. The air-fuel ratio A/F in the stratified combustion mode is controlled to an extremely leaner value (e.g. 27 to 60) than the stoichiometric air-fuel ratio by controlling the throttle valve 10 to be substantially fully open.

On the other hand, in the homogeneous combustion mode, fuel is injected into the combustion chamber 3*c* during an intake stroke, and the air-fuel mixture formed by fuel jets and a flow of air taken in from the intake pipe 4 is homogeneously distributed in the combustion chamber 3*c*, whereby the mixture is burned by homogeneous combustion. The air-fuel ratio A/F in the homogeneous combustion mode is controlled to a richer value (e.g. 14.7 to 27) than that in the stratified combustion mode by controlling the opening of the throttle valve 10 to be smaller than in the stratified combustion mode. The target valve lift amount LCMD of the EGR control valve 13 for the homogeneous combustion mode is set to a smaller value than that for the stratified combustion mode.

In the double-injection mode, fuel is injected twice per cycle with an interval between the two injections, and a richer air-fuel mixture (e.g. 12 to 22) is burned than in the stratified combustion mode. In this case, the two injections are carried out, one during an intake stroke and the other during a compression stroke. The reason for executing the double-injection mode is that there are large differences in the respective target values of the intake air amount and the EGR rate, between the stratified combustion mode and the homogeneous combustion mode, as described hereinabove, and after switching the combustion mode, it takes time for the actual intake air amount and the EGR rate to converge to respective values suitable for a combustion mode after the switching. During the transitional time period, the fuel injection is executed two times in a divided manner, to thereby prevent a misfire from occurring and reduce a torque step.

Figure 2:
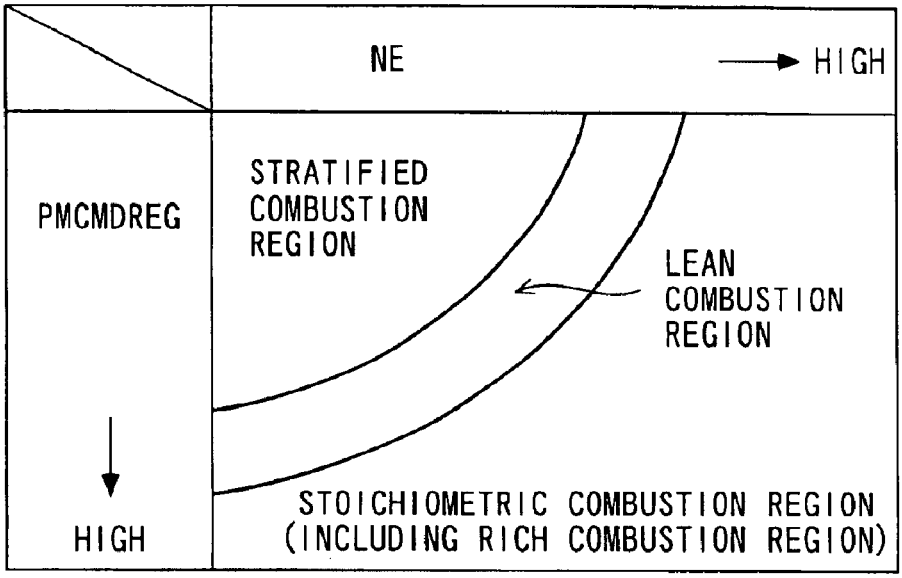
FIG. 2 is a map for use in determining a combustion mode.

The determination of a combustion mode is performed based on a map shown in FIG. 2, and the value of a combustion mode monitor ST_EMOD indicative of a selected combustion mode is set according to the determination. More specifically, in the present map, for a stratified combustion region where both the demanded torque PMCMDREG and the engine speed NE are low, the stratified combustion mode is designated, and the combustion mode monitor ST_EMOD is set to 2. On the other hand, for a lean combustion region included in a homogeneous combustion region, where the demanded torque PMCMDREG and the engine speed NE are both higher than in the stratified combustion region, the lean combustion mode is designated, and the combustion mode monitor ST_EMOD is set to 1. Further, for a stoichiometric combustion region included in the homogeneous combustion region, where the demanded torque PMCMDREG and the engine speed NE are both higher than in the lean combustion region, the stoichiometric combustion mode is designated, and the combustion mode monitor ST_EMOD is set to 0. It should be noted that the stoichiometric combustion region defined in the present map includes not only a region in which the air-fuel mixture is burned mainly at the stoichiometric air-fuel ratio, but also a region in which the air-fuel mixture is burned at a richer air-fuel ratio than the stoichiometric air-fuel ratio, and hence, stoichiometric combustion mentioned hereafter includes rich combustion.

In the following, the process for calculating the demanded fuel injection time period TCYLBS will be described with reference to a flowchart shown in FIG. 3. The present process is executed by an interrupt handling routine in synchronism with input of each TDC signal pulse. First, in a step 1 (shown as "S1"; this rule applies to all steps referred to hereinafter), the demanded torque PMCMDREG is calculated by searching a map, not shown, according to the engine speed NE and the accelerator pedal opening AP.

Then, an immediately preceding value TCYLBS1 of the demanded fuel injection time period is set to a value of the demanded fuel injection time period TCYLBS at this time (calculated in the immediately preceding loop) (step 2), and a target air-fuel ratio KCMD is calculated (step 3). The target air-fuel ratio KCMD is calculated by multiplying a basic target air-fuel ratio KBS by an engine coolant temperature-dependent correction coefficient KTW. The basic target air-fuel ratio KBS is calculated by searching a map, not shown, according to the engine speed NE and the demanded torque PMCMDREG, while the engine coolant temperature-dependent correction coefficient KTW is calculated by searching a map, not shown, according to the engine coolant temperature TW and the intake pipe absolute pressure PBA.

Then, it is determined whether or not a start mode flag F_STMOD is equal to 1 (step 4). If the answer to the question is affirmative (YES), i.e. if the engine 3 is being cranked, the demanded fuel injection time period TCYLBS is set to a value obtained by multiplying a basic fuel injection time period TIM by the target air-fuel ratio KCMD calculated in the step 3 (step 5), followed by terminating the present program. It should be noted that the basic fuel injection time period TIM is calculated by searching a map, not shown, according to the engine speed NE and the intake pipe absolute pressure PBA.

If the answer to the question of the step 4 is negative (NO), i.e. if the engine 3 has been started, a normal-time demanded fuel injection time period TCYLTMP (normal-time demanded fuel amount) is calculated, using the target air-fuel ratio KCMD and the basic fuel injection time period TIM calculated in the respective steps 3 and 5, by the following equation (1) (step 6):

$$TCYLTMP=TIM\cdot KCMD\cdot KEGR\cdot KAF\cdot KAST\cdot KLS \quad (1)$$

wherein KEGR represents an EGR-dependent correction coefficient for compensating for a change in the amount of intake air caused by a change in the EGR rate, and the EGR-dependent correction coefficient KEGR is set according to the target valve lift amount LCMD, the actual valve lift amount LACT, and the intake pipe absolute pressure PBA; KAF represents a feedback correction coefficient for feedback control of the air-fuel ratio of the air-fuel mixture such that the output KACT from the LAF sensor 25 converges to the target air-fuel ratio KCMD, and the feedback correction coefficient KAF is set according to the actual air-fuel ratio of each cylinder estimated by an observer based on the output KACT from the LAF sensor 25, the target air-fuel ratio KCMD, etc.; KAST represents a start-time correction coefficient for increasing the fuel injection amount at the start of the engine 3; and KLS represents a deceleration-time leaning correction coefficient for suppressing enriching of the air-fuel ratio during deceleration of the engine 3.

Then, a switching-time limiting process is executed (step 7). In the switching-time limiting process, a switching-time demanded fuel injection time period TCYLLMT is calculated as described hereinafter. Next, the calculated switching-time demanded fuel injection time period TCYLLMT is set to the demanded fuel injection time period TCYLBS (step 8), and an immediately preceding value PMCMDREG1 of the demanded torque is set to a value of the demanded torque PMCMDREG calculated in the current loop (step 9), followed by terminating the present program.

Figure 3:
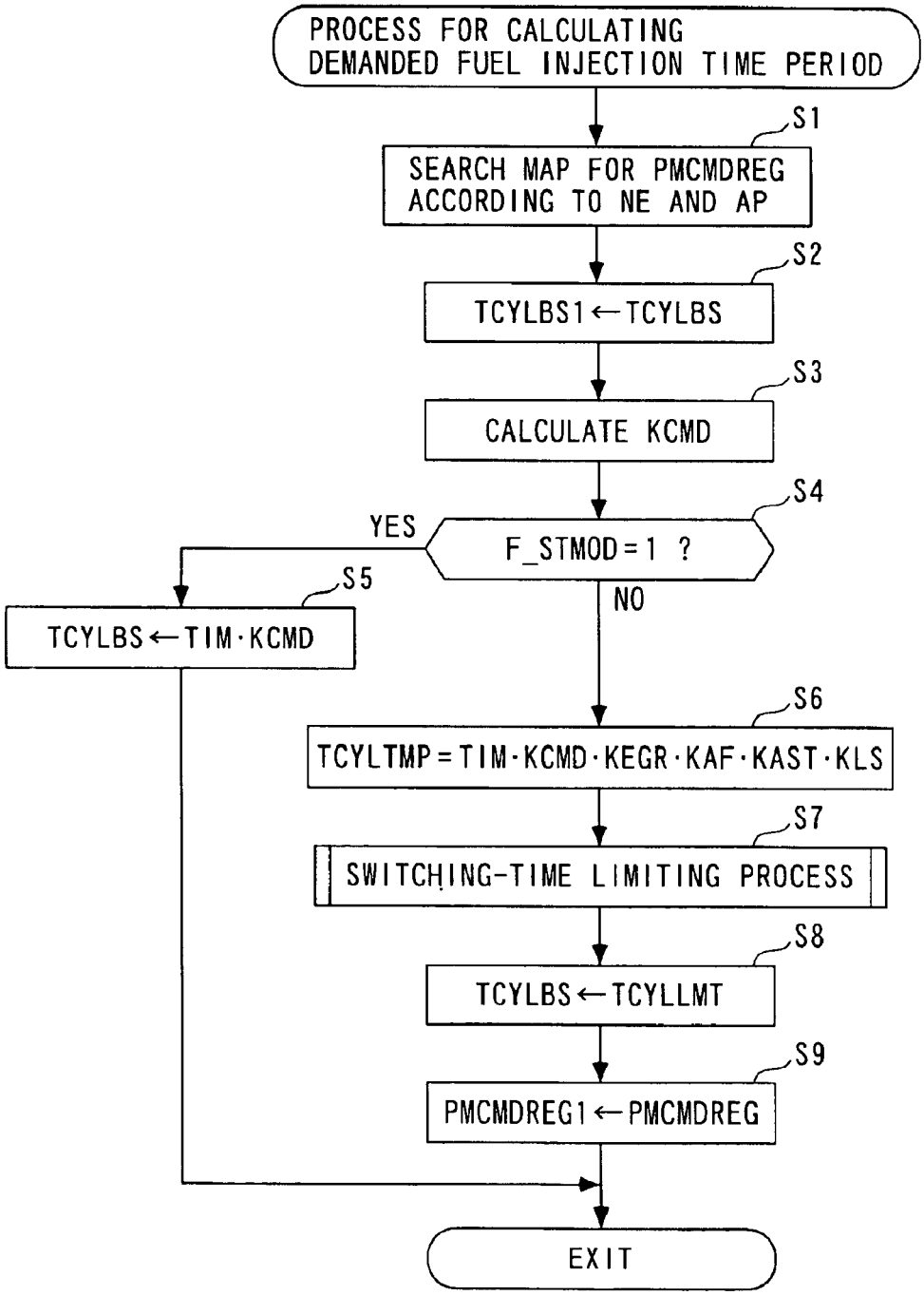
FIG. 3 is a flowchart showing a process for calculating a demanded fuel injection time period.
Figure 4:
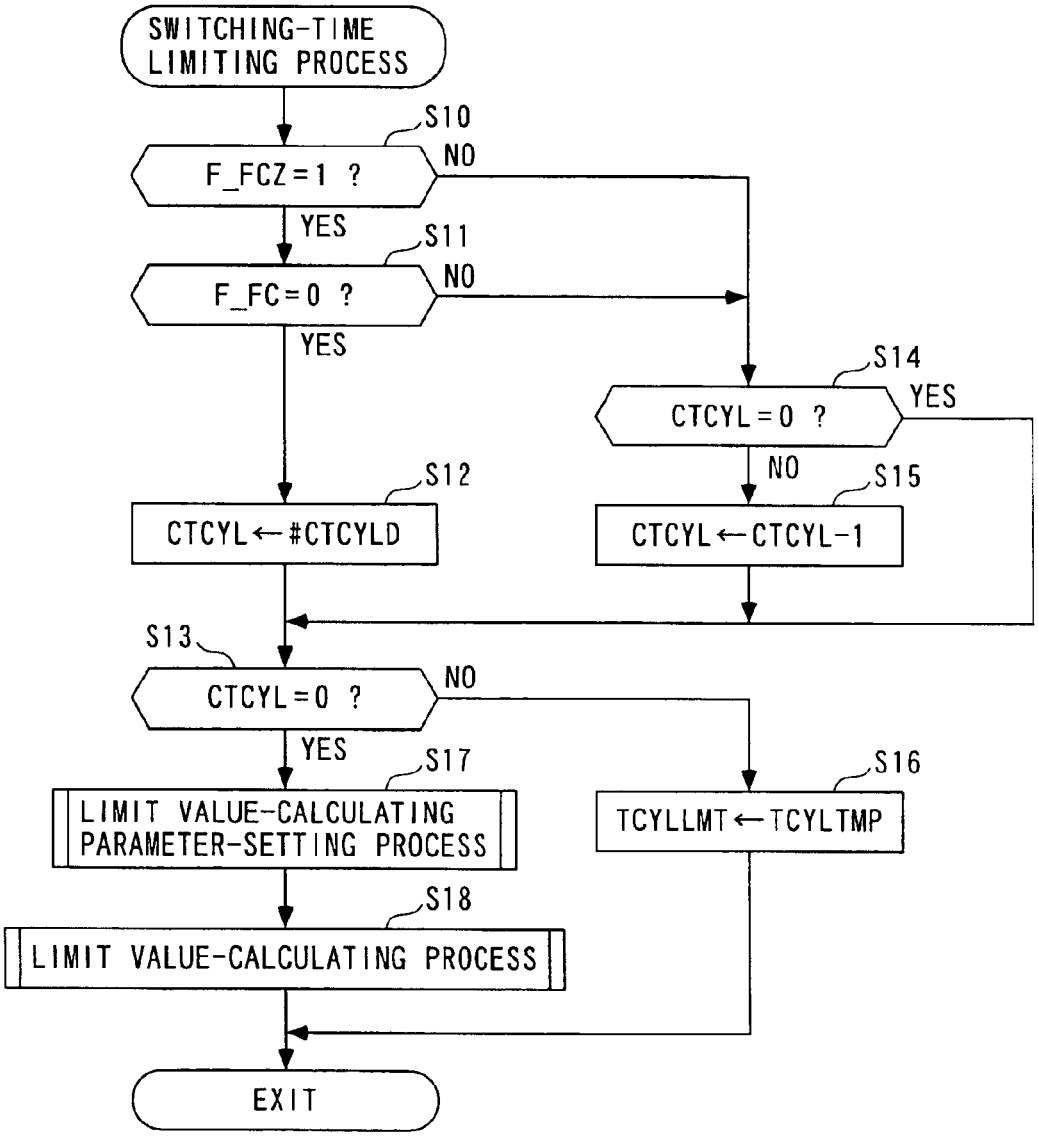
FIG. 4 is a flowchart showing the subroutine of a switching-time limiting process which is executed in a step 7 in FIG. 3.

FIG. 4 is a flowchart showing the subroutine of the switching-time limiting process executed in the step 7 in FIG. 3. The present process is executed so as to calculate a limit value TCYLLT (switching-time demanded fuel injection amount) for limiting the normal-time demanded fuel injection time period TCYLTMP set as described above, according to a selected one of switching patterns between combustion modes. More specifically, the intake air amount and the EGR rate to be set for the stratified combustion mode are quite different from those to be set for the homogeneous combustion mode, as described hereinbefore, and there is response delay in the intake air amount and the EGR rate. Therefore, the normal-time demanded fuel injection time period TCYLTMP set according to the intake air absolute pressure PBA tends to sharply increase when the combustion mode is switched from the stratified combustion mode to the homogeneous combustion mode and sharply decrease when the combustion mode is switched from the homogeneous combustion mode to the stratified combustion mode. The limit value TCYLLT is calculated to limit the normal-time demanded fuel injection time period TCYLTMP which has such a tendency. Therefore, the limit value TCYLLT is set such that the normal-time demanded fuel injection time period TCYLTMP is limited in a decreasing direction (i.e. such that it is decreased) when the combustion mode is switched to the homogeneous combustion mode, and limited in an increasing direction (i.e. such that it is increased) when the combustion mode is switched to the stratified combustion mode.

First, it is determined in respective steps 10 and 11 whether or not an immediately preceding value F_FCZ of an F/C execution flag is equal to 1 and whether or not a current value F_FC of the same is equal to 0. The F/C execution flag F_FC is set to 1 during an F/C operation of the engine.

If the answers to the questions are both affirmative (YES), i.e. if the current loop is being executed immediately after termination of an F/C operation, the count CTCYL of a delay counter is set to a predetermined value #CTCYLD (e.g. 28 corresponding to 28 TDC signal pulses) (predetermined time period) in a step 12, followed by the program proceeding to a step 13.

On the other hand, if either of the answers to the questions of the steps 10 and 11 is negative (NO), i.e. if the current loop is not being executed immediately after termination of an F/C operation, it is determined whether or not the count CTCYL of the delay counter is equal to 0 (step 14). If the answer to this question is negative (NO), the count CTCYL of the delay counter is decremented (step 15), followed by the program proceeding to the step 13, whereas if the answer to the question is affirmative (YES), the program directly proceeds to the step 13.

In the step 13, it is determined whether or not the count CTCYL of the delay counter is equal to 0. If the answer to this question is negative (NO), i.e. if a time period corresponding to the predetermined value #CTCYLD has not elapsed after the termination of the F/C operation, calculation of the limit value TCYLLT is inhibited, and the switching-time demanded fuel injection time period TCYLLMT is set to the normal-time demanded fuel injection time period TCYLTMP (step 16), followed by terminating the program. The reason for inhibiting the calculation of the limit value TCYLLT as described above is as follows: The limit value TCYLLT is set, as described in detail hereinafter, to a value obtained by multiplying the demanded fuel injection time period TCYLBS1 calculated in the immediately preceding loop, a combustion efficiency parameter KLMTCYH, KLMTCYSD or KLMTCYLD, and a ratio between the current value PMCMDREG and the immediately preceding value PMCMDREG1 of the demanded torque, by each other, and hence if the limit value TCYLLT were calculated immediately after the termination of the F/C operation of the engine, i.e. when the demanded fuel injection time period TCYLBS1 in the immediately preceding loop is equal to 0, the limit value TCYLLT would assume a value of 0 from then on, which makes it impossible to set the limit value TCYLLT properly.

On the other hand, if the answer to the question of the step 13 is affirmative (YES), i.e. if CTCYL=0 holds, which means that the time period corresponding to the predetermined value #CTCYLD has elapsed after the termination of the F/C operation, a limit value-calculating parameter-setting process is executed (step 17) for setting parameters for use in calculating the limit value TCYLLT, and then a limit value-calculating process is executed (step 18), followed by terminating the present program.

Figure 5:
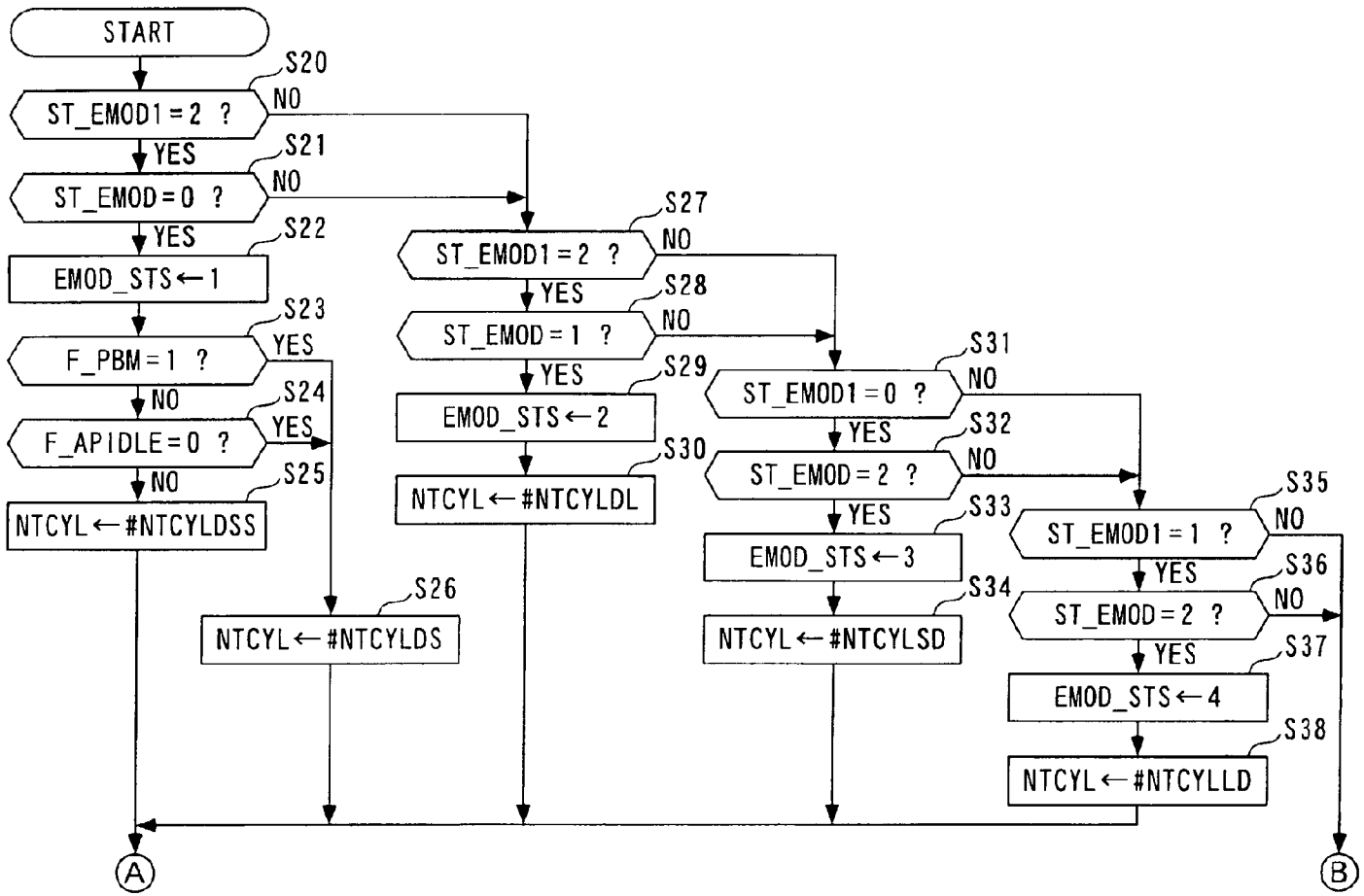
FIG. 5 is a flowchart showing the subroutine of a limit value-calculating parameter-setting process which is executed in a step 17 in FIG. 4.
Figure 6:
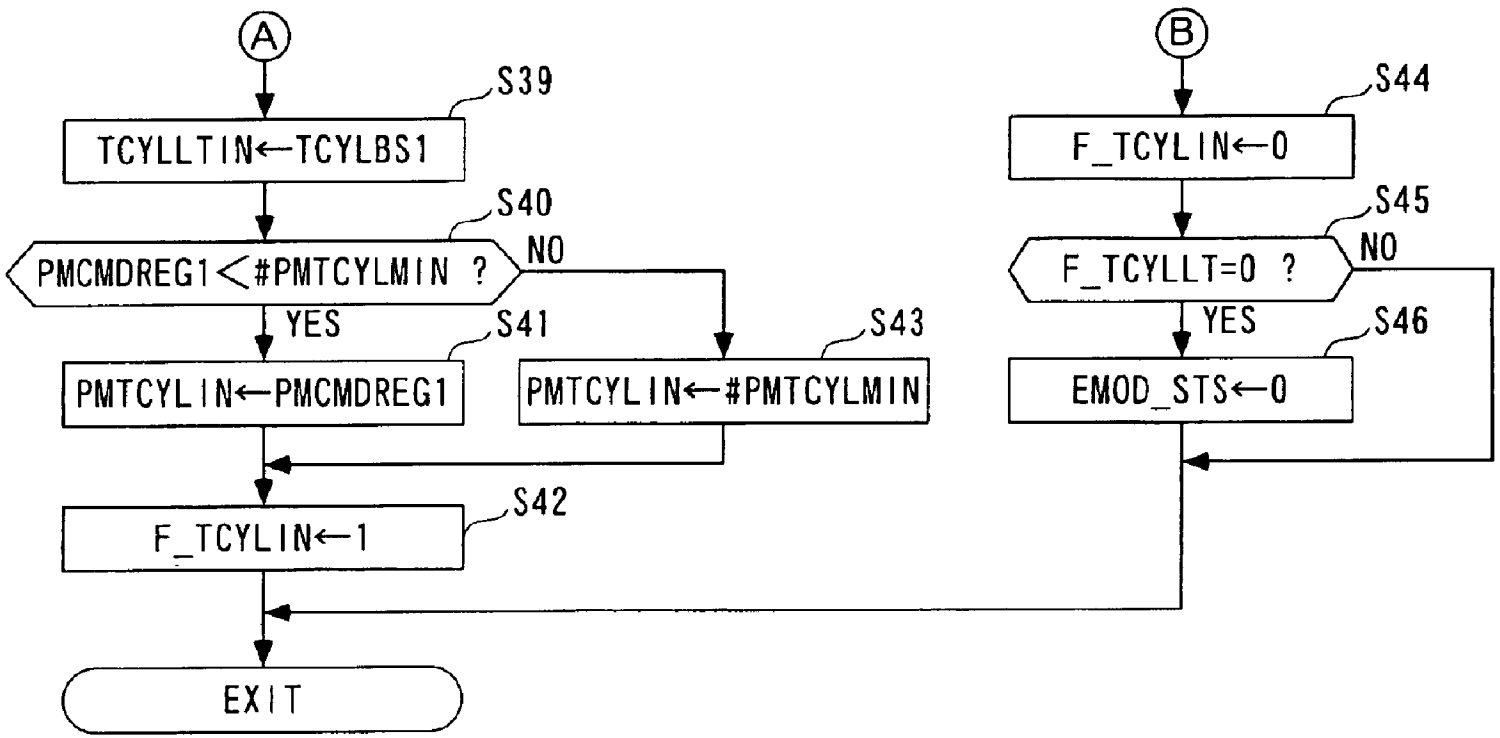
FIG. 6 is a continuation of the FIG. 5 flowchart.

FIGS. 5 and 6 are a flowchart showing the subroutine of the limit value-calculating parameter-setting process executed in the step 17 in FIG. 4. First, it is determined in respective steps 20 and 21 whether or not the immediately preceding value ST_EMOD1 of the aforementioned combustion mode monitor ST_EMOD is equal to 2 and whether or not the current combustion mode monitor ST_EMOD is equal to 0. If the answers to these questions are both affirmative (YES), i.e. if the current loop is being executed immediately after the combustion mode is switched from the stratified combustion mode to the stoichiometric combustion mode, a switching status EMOD_STS is set to 1 (step 22).

Then, in respective steps 23 and 24, it is determined whether or not a negative pressure request flag F_PBM is equal to 1 and whether or not an accelerator pedal fully-closed flag F_APIDLE is equal to 0. The negative pressure request flag F_PBM is set to 1 when sufficient negative pressure is not maintained in the brake booster 9 and it is judged that the negative pressure should be increased. When the negative pressure request flag F_PBM is set to 1, setting of the combustion mode to the stratified combustion mode or the lean combustion mode is inhibited, and the combustion mode is forcibly set to the stoichiometric combustion mode. The accelerator pedal fully-closed flag F_APIDLE is set to 0 when the accelerator pedal is fully closed, i.e. when it is not stepped on.

If the answers to these questions of the steps 23 and 24 are both negative (NO), i.e. if there is no negative pressure request and the accelerator pedal is stepped on, a limit time period NTCYL (predetermined time period) is set to a first predetermined time period (count) #NTCYLDSS (corresponding to e.g. 500 msec) (step 25), whereas if either of the answers to these questions is affirmative (YES), the limit time period NTCYL is set to a second predetermined time period #NTCYLDS (corresponding to e.g. 1000 msec) (step 26). The limit time period NTCYL sets an execution time period over which the limiting process is executed by the limit value TCYLLT, as a number to be counted by a limit time counter TCYLT10MS, referred to hereinafter, on a switching pattern-by-switching pattern basis. The calculation of the limit value TCYLLT is performed within the limit time period NTCYL. It should be noted that the second predetermined time period #NTCYLDS is set to be longer than the first predetermined time period #NTCYLDSS. This is because when there is the negative pressure request, the volume to be made negative in pressure is increased by an amount corresponding to the volume of the brake booster 9, and hence it takes a longer time to stabilize the intake pipe absolute pressure PBA, which requires a prolonged execution time period of the limiting process. Further, in the very low-load operating condition of the engine where the accelerator pedal is not stepped on, since the combustion mode of the engine is switched in a state where the demanded torque PMCMDREG is not increased, it takes time before an actual intake air amount after the switching of the combustion mode reaches a value suitable for the combustion mode after the switching, which requires a prolonged execution time period of the limiting process.

On the other hand, if either of the answers to the questions of the steps 20 and 21 is negative (NO), it is determined in respective steps 27 and 28 whether or not the immediately preceding value ST_EMOD1 of the combustion mode monitor is equal to 2 and whether or not the current combustion mode monitor ST_EMOD is equal to 1. If the answers to these questions are both affirmative (YES), i.e. if the combustion mode has just been switched from the stratified combustion mode to the lean combustion mode, the switching status EMOD_STS is set to 2 (step 29), and the limit time period NTCYL is set to a third predetermined time period #NTCYLDL (corresponding to e.g. 400 msec) (step 30).

If either of the answers to the questions of the steps 27 and 28 is negative (NO), it is determined in respective steps 31 and 32 whether or not the immediately preceding value ST_EMOD1 of the combustion mode monitor is equal to 0 and whether or not the current combustion mode monitor ST_EMOD is equal to 2. If the answers to these questions are both affirmative (YES), i.e. if the combustion mode has just been switched from the stoichiometric combustion mode to the stratified combustion mode, the switching status EMOD_STS is set to "3" (step 33), and the limit time period NTCYL is set to a fourth predetermined time period #NTCYLSD (corresponding to e.g. 600 msec) (step 34).

If either of the answers to the questions of the steps 31 and 32 is negative (NO), it is determined in respective steps 35 and 36 whether or not the immediately preceding value ST_EMOD1 of the combustion mode monitor is equal to 1 and whether or not the current combustion mode monitor ST_EMOD is equal to 2. If the answers to these questions are both affirmative (YES), i.e. if the combustion mode has just been switched from the lean combustion mode to the stratified combustion mode, the switching status EMOD_STS is set to "4" (step 37), and the limit time period NTCYL is set to a fifth predetermined time period #NTCYLLD (corresponding to e.g. 600 msec) (step 38). It should be noted that in view of the above, described fact that the target valve lift amount LCMD of the EGR control valve 13 is set to a largely different value between the stratified combustion mode and the homogeneous combustion mode, and of the response of the EGR control valve 13, the first predetermined time period #NTCYLDSS and the third to fifth predetermined time periods #NTCYLDL, #NTCYLSD and #NTCYLLD is set to respective time periods required for the actual valve lift amount LACT to positively reach a value suitable for a combustion mode after the switching. Further, in the above example, the fourth and fifth predetermined time periods #NTCYLSD and #NTCYLLD applied when the combustion mode is switched to the stratified combustion mode are set to be longer than the first and third predetermined time periods #NTCYLDSS and #NTCYLDL applied when the combustion mode is switched from the stratified combustion mode. This is because when the EGR control valve 13 is closed, the valve element of the EGR control valve 13 receives not only a driving force of the stepper motor acting in the valve-closing direction, but also a reaction force of the spring acting in the valve-closing direction, and hence a time period required for closing the valve element is shorter than a time period required for opening the same. Thus, the limiting operation using the limit value TCYLLT can be positively executed during a delayed response of the EGR control valve 13.

In a step 39 following the steps 25, 26, 30, 34, or 38, a pre-switching demanded fuel injection time period TCYLLTIN (i.e. a demanded fuel amount calculated immediately before the combustion mode has been switched) is set to the immediately preceding value TCYLBS1 of the demanded fuel injection time period. Then, it is determined whether or not the immediately preceding value PMCMDREG1 of the demanded torque PMCMDREG is smaller than a predetermined upper limit value #PMTCYLMIN (e.g. 1.2 kgf/cm$^2$) (step 40).

If the answer to this question is affirmative (YES), a pre-switching demanded torque PMTCYLIN (i.e. a demanded torque calculated immediately before switching of the combustion mode) is set to the immediately preceding value PMCMDREG1 of the demanded torque (step 41), and a parameter setting completion flag F_TCYLIN is set to 1 (step 42) to indicate that combustion mode switching in one of the four switching patterns has just been executed and that the setting of the parameters for use in calculating the limit value TCYLLT is completed, followed by terminating the present program. If the answer to the question of the step 40 is negative (NO), i.e. if PMCMDREG1≧#PMTCYLMIN holds, the pre-switching demanded torque PMTCYLIN is set to the predetermined upper limit value #PMTCYLMIN (step 43), and then the step 42 is executed, followed by terminating the present program.

On the other hand, if either of the answers to the questions of the steps 35 and 36 is negative (NO), i.e. if the combustion mode has not been switched in any of the four switching pattern, the parameter setting completion flag F_TCYLIN is set to 0 (step 44), and it is determined whether or not a limitation permitting flag F_TCYLLT is equal to 0 (step 45). If the answer to this question is negative (NO), i.e. if the limiting operation using the limit value TCYLLT is being executed, the present program is immediately terminated, whereas if the answer to the question is affirmative (YES), the switching status EMOD_STS is reset to 0 (step 46), followed by terminating the present program.

Figure 7:
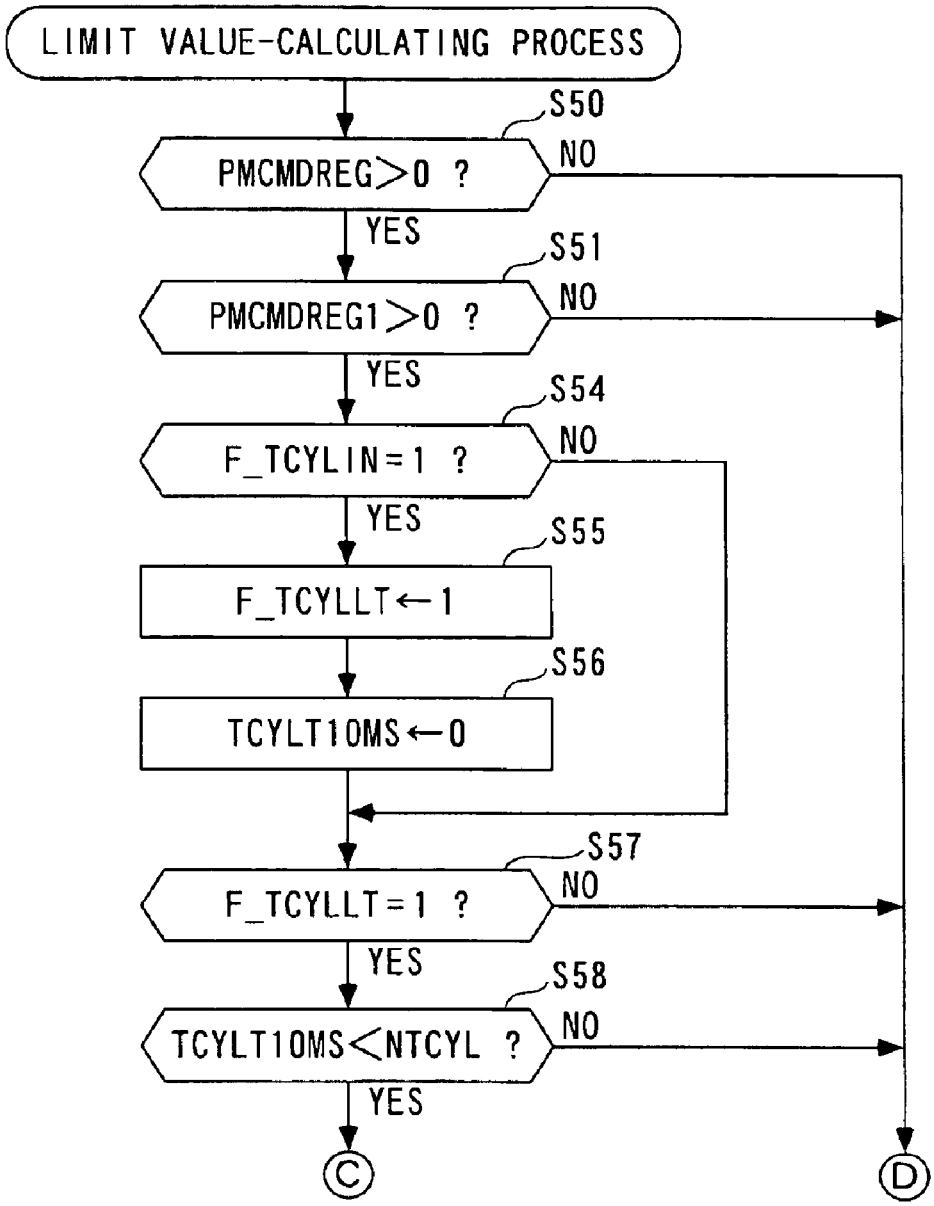
FIG. 7 is a flowchart showing the subroutine of a limit value-calculating process which is executed in a step 18 in FIG. 4.
Figure 8:
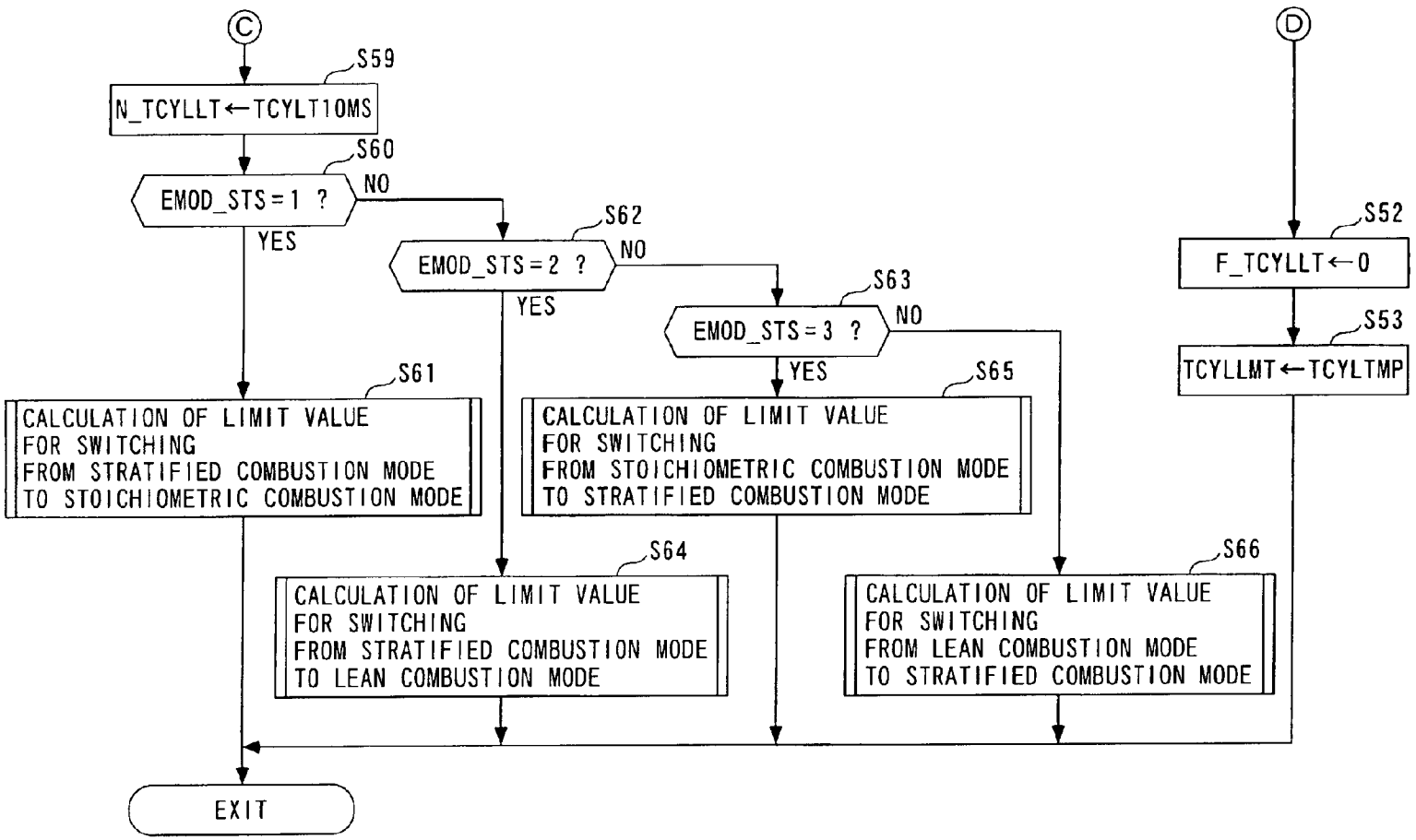
FIG. 8 is a continuation of the FIG. 7 flowchart.

FIGS. 7 and 8 are a flowchart showing the subroutine of the limit value-calculating process executed in the step 18 in FIG. 4. First, in respective steps 50 and 51, it is determined whether or not the demanded torque PMCMDREG and its immediately receding value PMCMDREG1 are larger than 0. If either of the answers to these questions is negative (NO), which means that no torque to the engine 3 is requested, the limitation permitting flag F_TCYLLT is set to 0 (step 52) to inhibit calculation of the limit value TCYLLT, and the switching-time demanded fuel injection time period TCYLLMT is set to the normal-time demanded fuel injection time period TCYLTMP (step 53), followed by terminating the present program.

On the other hand, if the answers to these questions of the steps 50 and 51 are both affirmative (YES), it is determined whether or not the parameter setting completion flag F_TCYLIN is equal to 1 (step 54). If the answer to this question is affirmative (YES), i.e. if the current loop is being executed immediately after the switching of the combustion mode in any of the four switching patterns, the limitation permitting flag F_TCYLLT is set to 1 (step 55), and then the count TCYLT10MS of the limit time counter as an upcount timer is set to 0 (step 56), followed by the program proceeding to a step 57. The count TCYLT10MS of the limit time counter is incremented at intervals of a predetermined time period (e.g. 10 msec). It should be noted that a counter whose count is incremented whenever a TDC signal pulse is output may be used in place of the time counter.

If the answer to the question of the step 54 is negative (NO), i.e. if the current loop is not being executed immediately after the switching of the combustion mode, the steps 55 and 56 are skipped, and the program proceeds to the step 57.

In the step 57, it is determined whether or not the limitation permitting flag F_TCYLLT is equal to 1. If the answer to this question is affirmative (YES), it is determined whether or not the count TCYLT10MS of the limit time counter is smaller than the limit time period NTCYL set in the step 25, 26, 30, 34 or 38 (step 58).

If the answer to this question is affirmative (YES), i.e. if the time period corresponding to the limit time period NTCYL has not elapsed after the switching of the combustion mode, a post-switching elapsed time N_TCYLLT is set to the current count TCYLT10MS of the limit time counter (step 59). Then, in a step 60, it is determined whether or not the switching status EMOD_STS is equal to 1. If the answer to the question is affirmative (YES), i.e. if the combustion mode has been switched from the stratified combustion mode to the stoichiometric combustion mode, the limit value TCYLLT for use when the combustion mode is switched from the stratified combustion mode to the stoichiometric combustion mode is calculated (step 61). Similarly, in a step 62, it is determined whether or not the switching status EMOD_STS is equal to 2, and if the answer to the question is affirmative (YES), the limit value TCYLLT for use when the combustion mode is switched from the stratified combustion mode to the lean combustion mode is calculated (step 64), followed by terminating the present program. If the answer to this question is negative (NO), it is determined in a step 63 whether or not the switching status EMOD_STS is equal to "3". If the answer to this question is affirmative (YES), the limit value TCYLLT for use when the combustion mode is switched from the stoichiometric combustion mode to the stratified combustion mode is calculated (step 65), followed by terminating the present program, whereas if the answer to the question of the step 63 is negative (NO), the limit value TCYLLT for use when the combustion mode is switched from the lean combustion mode to the stratified combustion mode is calculated (step 66), followed by terminating the present program.

On the other hand, if the answer to the question of the step 58 is negative (NO), i.e. if the time period corresponding to the limit time period NTCYL has elapsed after the switching of the combustion mode, it is judged that the execution period for the limiting operation using the limit value TCYLLT is over, and the steps 52 et seq. are executed to set the limitation permitting flag F_TCYLLT to 0 and then the switching-time demanded fuel injection time period TCYLLMT to the normal-time demanded fuel injection time period TCYLTMP, followed by terminating the present program.

Further, after the execution period for the limiting operation using the limit value TCYLLT is over, since the step 52 is executed, the answer to the question of the step 57 becomes negative (NO), so that in this case, the steps 52 et seq. are executed, followed by terminating the present program.

Figure 9:
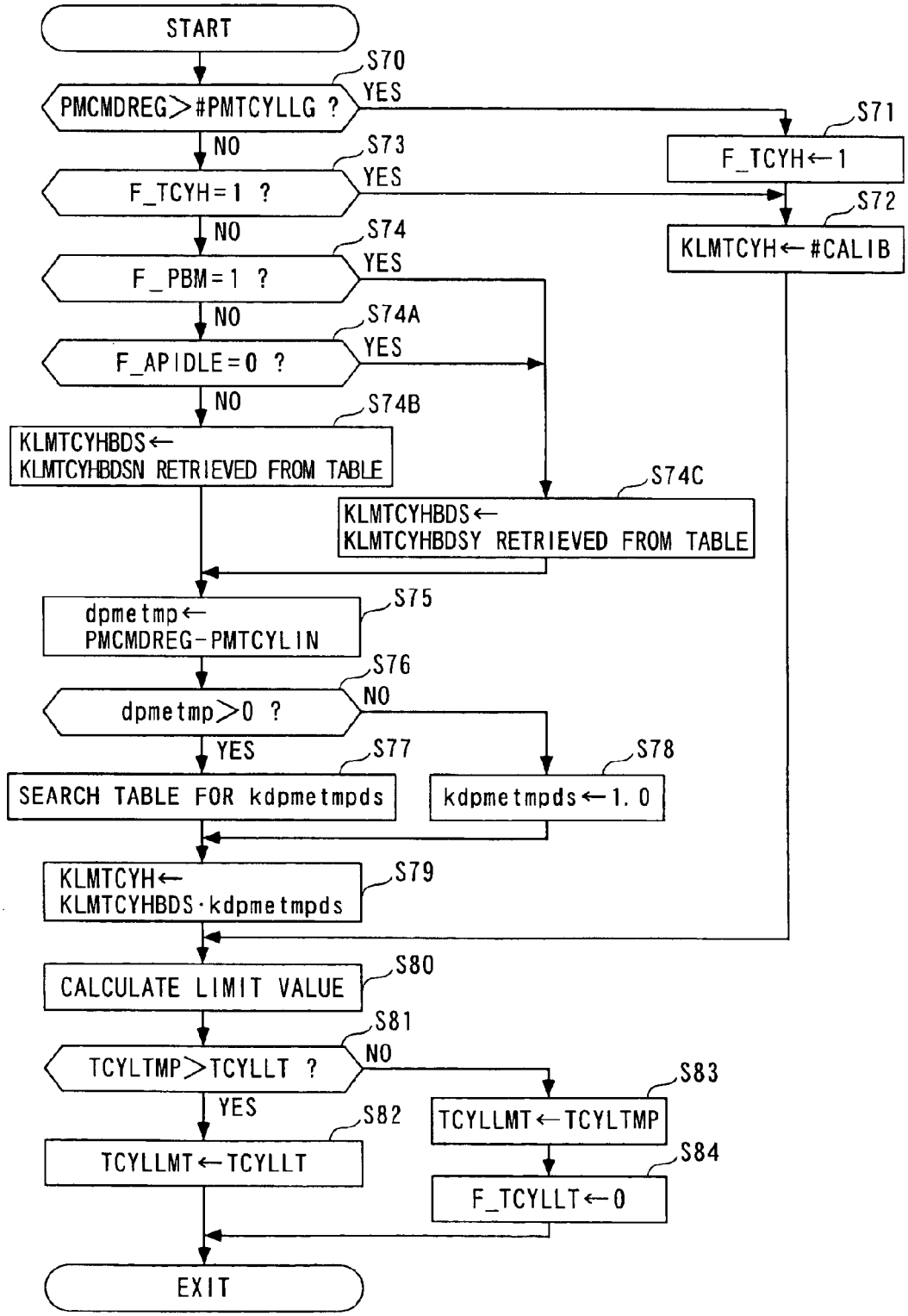
FIG. 9 is a flowchart showing the subroutine of a process for calculating a limit value when the combustion mode is switched from a stratified combustion mode to a stoichiometric combustion mode, which is executed in a step 61 in FIG. 8.

FIG. 9 is a flowchart showing the subroutine of the process for calculating the limit value TCYLLT for use when the combustion mode is switched from the stratified combustion mode to the stoichiometric combustion mode (for use in a first switching pattern), which is executed in the step 61 in FIG. 8. First, in a step 70, it is determined whether or not the demanded torque PMCMDREG is larger than a predetermined upper limit torque #PMTCYLLG. If the answer to this question is affirmative (YES), i.e. if the demanded torque PMCMDREG is very large, an off-demanded torque region flag F_TCYH is set to 1 (step 71), and the combustion efficiency parameter KLMTCYH is set to a predetermined value #CALIB (step 72). The predetermined value #CALIB is set to a larger value than the combustion efficiency parameter KLMTCYH calculated as described hereinafter.

On the other hand, if the answer to the question of the step 70 is negative (NO), i.e. if PMCMDREG≦#PMTCYLLG holds, it is determined whether or not the off-demanded torque region flag F_TCYH is equal to 1 (step 73). If the answer to this question is affirmative (YES), the step 72 is executed. As described above, even if the demanded torque PMCMDREG becomes smaller than the upper limit torque #PMTCYLLG after having once exceeded it, the combustion efficiency parameter KLMTCYH is held at the predetermined value #CALIB unless the combustion mode is switched.

If the answer to the question of the step 70 is negative (NO), i.e. if the demanded torque PMCMDREG has never exceeded the upper limit torque #PMTCYLLG after the switching of the combustion mode, it is determined in respective steps 74 and 74A whether or not the negative pressure request flag F_PBM is equal to 1 and whether or not the accelerator pedal fully-closed flag F_APIDLE is equal to 0. If the answers to these questions are both negative (NO), i.e. if there is no negative pressure request for increasing negative pressure within the brake booster 9, and the accelerator pedal is stepped on, the combustion efficiency coefficient KLMTCYHBDS is set to a value retrieved from a KLMTCYHBDSN table for a negative pressure non-request time, which is indicated by a solid line in FIG. 10, according to the post-switching elapsed time N_TCYLLT set in the step 59 in FIG. 8 (step 74B). The table value KLMTCYHBDSN is set such that it progressively increases as the post-switching elapsed time N_TCYLLT becomes larger, i.e. as the time period elapsed after the switching of the combustion mode becomes longer, until a first predetermined time period T1 (e.g. 600 msec) elapses after the switching of the combustion mode. At this time point, the table value KLMTCYHBDSN is set to a predetermined value KDS1 (e.g. 0.8), and after the time point, set to a maximum value KDSMAX (e.g. 4.0) larger than the predetermined value KDS1.

Figure 10:
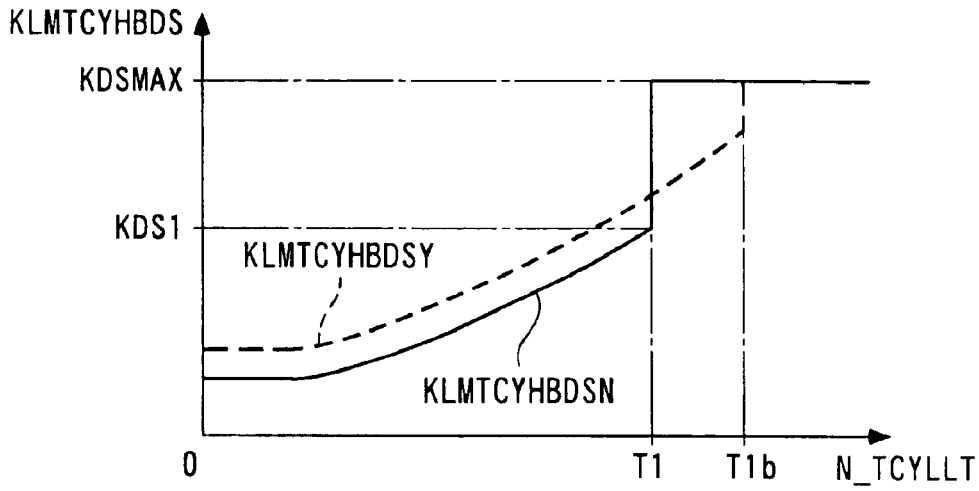
FIG. 10 is a diagram showing an example of a table for setting a combustion efficiency coefficient KLMTCYHBDS, depending on whether or not there is a negative pressure request.

If either of the answers to the questions of the steps 74 and 74A is affirmative (YES), the combustion efficiency coefficient KLMTCYHBDS is set to a value retrieved from a KLMTCYHBDSY table for a negative pressure request time, which is indicated by a broken line in FIG. 10, according to the post-switching elapsed time N_TCYLLT similarly to the step 74B (step 74C). The table value KLMTCYHBDSY is set such that it assumes higher values than the table value KLMTCYHBDSN, as a whole, and that it continuously increases until a predetermined time period T1*b* (e.g. 1100 msec) longer than the first predetermined time period T1 elapses after the switching of the combustion mode, and after the time point, it is set to the maximum value KDSMAX. In short, the table value KLMTCYHBDSY is set such that it continuously increases over a longer time period than the table value KLMTCYHBDSN.

Figure 11:
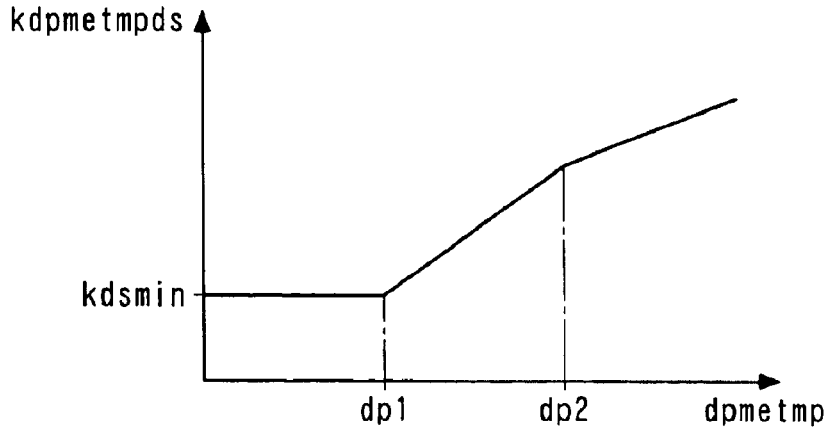
FIG. 11 is a diagram showing an example of a dpmetmp-kdpmetmpds table used in a step 77 in FIG. 9 and a step 106 in FIG. 13.

Then, a value obtained by subtracting the pre-switching demanded torque PMTCYLIN set in the step 41 or 43 in FIG. 6 from the demanded torque PMCMDREG is calculated as a torque difference dpmetmp (difference between the stored demanded torque and the demanded torque currently calculated) (step 75), and it is determined whether or not the torque difference dpmetmp is larger than 0 (step 76). If the answer to this question is affirmative (YES), i.e. if the demanded torque PMCMDREG is larger than the pre-switching demanded torque PMTCYLIN, a correction coefficient kdpmetmpds is calculated by searching a dpmetmp-kdpmetmpds table shown in FIG. 11, according to the torque difference dpmetmp (step 77). In this table, the correction coefficient kdpmetmpds is set to a minimum value kdsmin (e.g. 1.0) when the torque difference dpmetmp is equal to or smaller than a first predetermined value dp1 (e.g. 1.2 kgf/$cm^2$), and set, when the torque difference dpmetmp is between the first predetermined value dp1 and a second predetermined value dp2 (e.g. 2.0 kgf/$cm^2$) larger than the first predetermined value dp1, such that the correction coefficient kdpmetmpds increases linearly with an increase in the torque difference dpmetmp. Further, when the torque difference dpmetmp is equal to or larger than the second predetermined value dp2, the correction coefficient kdpmetmpds increases linearly with a smaller gradient than when the torque difference dpmetmp becomes larger between the first and second predetermined values dp1 and dp2.

On the other hand, if the answer to the question of the step 76 is negative (NO), i.e. if the demanded torque PMCMDREG is equal to or smaller than the pre-switching demanded torque PMTCYLIN, the correction coefficient kdpmetmpds is set to 1.0 (step 78). Then, the combustion efficiency parameter KLMTCYH is set to a value obtained by multiplying the combustion efficiency coefficient KLMTCYHBDS calculated in the step 74B or 74C by the correction coefficient kdpmetmpds set in the step 77 or 78 (step 79).

In a step 80 following the step 72 or 79, the limit value TCYLLT is calculated, using the pre-switching demanded fuel injection time period TCYLLTIN set in the step 39 in FIG. 6, the combustion efficiency parameter KLMTCYH, the demanded torque PMCMDREG and the pre-switching demanded torque PMTCYLIN set in the step 41 or 43 in FIG. 6, by the following equation (2):

$$TCYLLT=TCYLLTIN\cdot(1+KLMTCYH)\cdot PMCMDREG/PMTCYLIN \quad (2)$$

In a low-load region where the switching of the combustion mode is executed, the combustion efficiency is generally lower in the homogeneous combustion mode than in the stratified combustion mode, and hence when the combustion mode is switched from the stratified combustion mode to the homogeneous combustion mode, the combustion efficiency decreases. Accordingly, the demanded fuel injection time period TCYLBS required to output the same magnitude of torque tends to increase. The value (1+KLMTCYH) in the above equation (2) corresponds to a degree of decrease in the combustion efficiency from a value thereof assumed immediately before the switching of the combustion mode. For this reason, in the above equation (2), the value (1+KLMTCYH) is used for multiplication, whereby the decrease in the combustion efficiency from the value thereof assumed immediately before the switching of the combustion mode is compensated for, thereby setting the limit value TCYLLT to a larger value than a value calculated without using the value (1+KLMTCYH).

Further, as described hereinbefore, in the table for the negative pressure request time and the table for the negative pressure non-request time, both shown in FIG. 10, the respective table values KLMTCYHBDSN and KLMTCYHBDSY are set such that they progressively increase with an increase in the post-switching elapsed time period N_TCYLLT, so that the limit value TCYLLT progressively increases as the table value KLMTCYHBDSN or KLMTCYHBDSY becomes larger, which makes it possible to ensure a minimal feeling of acceleration which should be obtained when the accelerator pedal is slowly stepped on. Further, in the table shown in FIG. 11, when the torque difference dpmetmp is larger than the first predetermined value dp1, and the demanded torque PMCMDREG is increased to some degree from a value thereof assumed immediately before the switching of the combustion mode, the correction coefficient kdpmetmpds is set to a larger value with an increase in the torque difference dpmetmp, so that it is possible to correct the combustion efficiency parameter KLMTCYH and the demanded fuel injection time period TCYLBS in respective increasing directions, thereby satisfying a driver's request for acceleration.

The reason for setting the combustion efficiency coefficient KLMTCYHBDS to a larger value, as described hereinbefore, when there is the negative pressure request, or when the accelerator pedal is not stepped on, than when there is no negative pressure request and the accelerator pedal is stepped on is as follows: In general, the negative pressure request is detected in a very low-load operating condition of the engine in which the accelerator pedal is not stepped on, and hence the difference in combustion efficiency between the stratified combustion mode and the stoichiometric combustion mode is larger when the negative pressure request is detected than when the same is not detected.

Then, it is determined whether or not the normal-time demanded fuel injection time period TCYLTMP is larger than the calculated limit value TCYLLT (step 81). If the answer to this question is affirmative (YES), the switching-time demanded fuel injection time period TCYLLMT is set to the limit value TCYLLT (step 82), followed by terminating the present program.

If the answer to the question of the step 81 is negative (NO), i.e. if TCYLTMP≦TCYLLT holds, the switching-time demanded fuel injection time period TCYLLMT is set to the normal-time demanded fuel injection time period TCYLTMP (step 83). Further, since the limit value TCYLLT is equal to or larger than the normal-time demanded fuel injection time period TCYLTMP, and hence the limiting operation using the limit value TCYLLT cannot be executed, the limitation permitting flag F_TCYLLT is set to 0 (step 84) to terminate the limiting operation, followed by terminating the present program.

It should be noted that in the FIG. 10 table referred to hereinbefore, the maximum value KDSMAX is set to a value which ensures that the limit value TCYLLT calculated using the maximum value KDSMAX becomes larger than the normal-time demanded fuel injection time period TCYLTMP to be calculated when the post-switching elapsed time period N_TCYLLT has exceeded the first predetermined time period T1 or the predetermined time period T1*b*. This setting is required so as to make the answer to the question of the step 81 negative (NO) when the first predetermined time period T1 or the predetermined time period T1*b* has elapsed, even if a longer time period than the first predetermined time period T1 or the predetermined time period T1*b* was erroneously input as the limit time period NTCYL, thereby positively terminating the limiting operation using the limit value TCYLLT.

Further, as described hereinbefore, when there is the negative pressure request or when the accelerator pedal is not stepped on, the time period for increasing the combustion efficiency coefficient KLMTCYHBDS is set to a larger value than when there is no negative pressure request and at the same time the accelerator pedal is stepped on. The reason for this setting is the same as described in the step 26, and the setting is executed to match the step 26.

Figure 12:
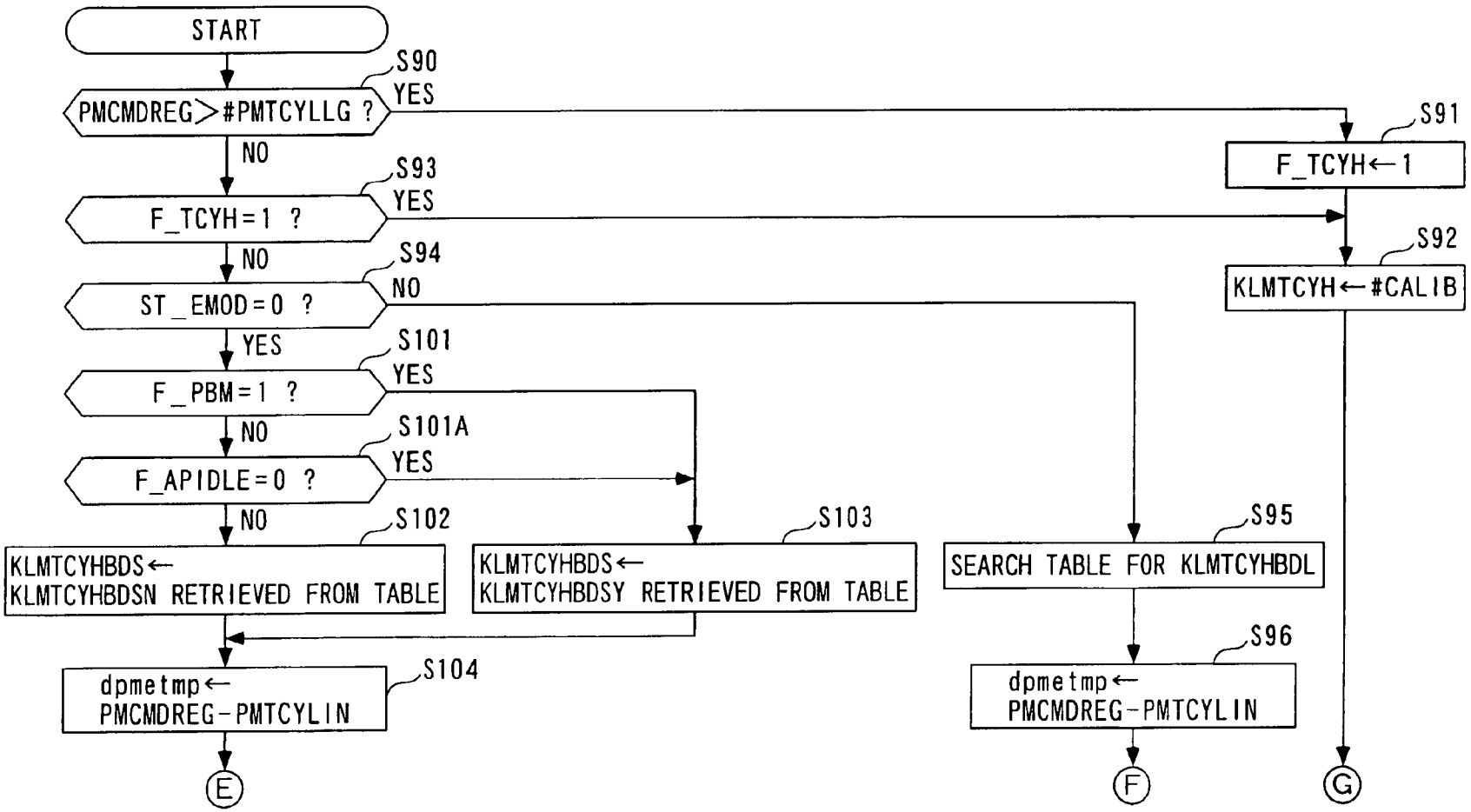
FIG. 12 is a flowchart showing the subroutine of a process for calculating the limit value when the combustion mode is switched from the stratified combustion mode to a lean combustion mode, which is executed in a step 64 in FIG. 8.
Figure 13:
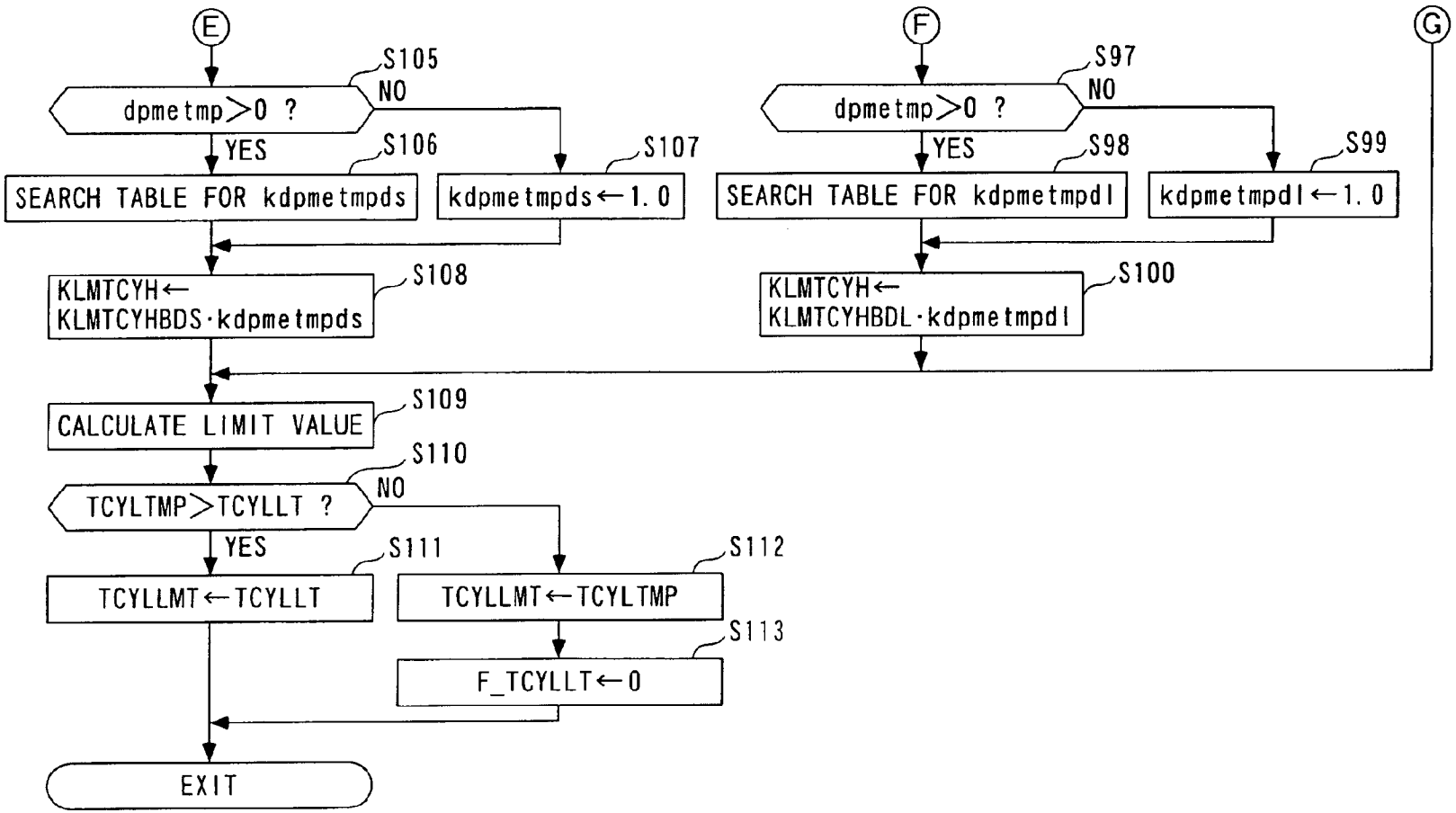
FIG. 13 is a continuation of the FIG. 12 flowchart.

FIGS. 12 and 13 are a flowchart showing the subroutine of a process executed in the step 64 in FIG. 8 for calculating the limit value for use when the combustion mode is switched from the stratified combustion mode to the lean combustion mode (for use in the first switching pattern). The present process is substantially the same as the above described process for calculating the limit value for use when the combustion mode is switched from the stratified combustion mode to the stoichiometric combustion mode, and distinguished from the latter process only in that it is determined whether the current combustion mode is the stoichiometric combustion mode or the lean combustion mode, and then the combustion efficiency parameter KLMTCYH is calculated for the determined one of the combustion modes.

The reason for calculating the combustion efficiency parameter KLMTCYH specifically for the determined one of the stoichiometric combustion mode and the lean combustion mode is as follows: As is apparent from the manner of setting the switching status EMOD_STS, described above, this status assumes a constant value even when the combustion mode is switched between the stoichiometric combustion mode and the lean combustion mode, and the switching from the lean combustion mode to the stoichiometric combustion mode is carried out in a very short time, and hence can be performed during execution of the limiting operation using the limit value TCYLLT. It should be noted that as shown in FIG. 12, the steps 90 to 93 are the same as the steps 70 to 73 in FIG. 9, and hence detailed description thereof is omitted. Therefore, hereafter, steps 94 et seq. following the step 93 will be described.

Figure 14:
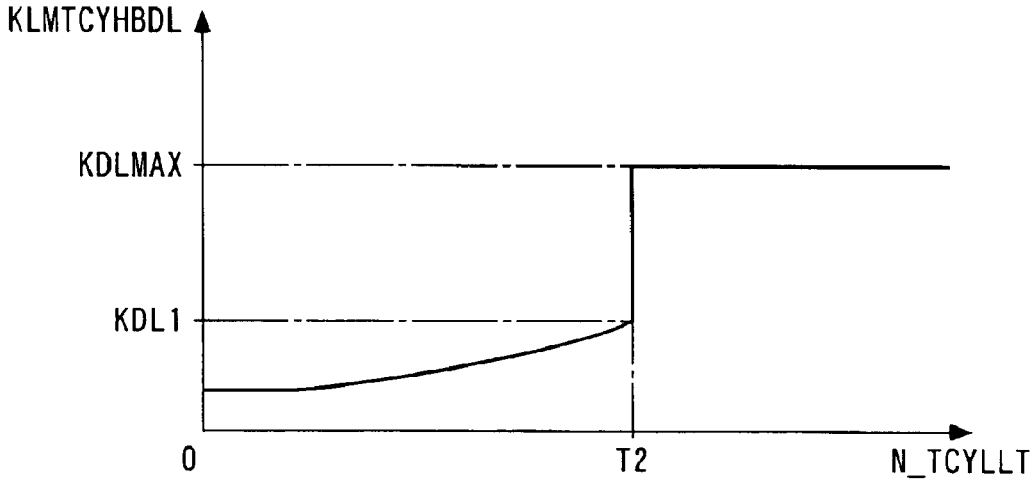
FIG. 14 is a diagram showing an example of an N_TCYLLT-KLMTCYHBDL table used in a step 95 in FIG. 12.

In the step 94, it is determined whether or not the combustion mode monitor ST_EMOD is equal to 0. If the answer to the question is negative (NO), i.e. if the combustion mode at the present time point is the lean combustion mode, the combustion efficiency coefficient KLMTCYHBDL for the lean combustion mode is calculated by searching an N_TCYLLT-KLMTCYHBDL table shown in FIG. 14, according to the post-switching elapsed time period N_TCYLLT (step 95). In this table, similarly to the FIG. 10 table, the combustion efficiency parameter KLMTCYHBDL is set such that it progressively increases with an increase in the post-switching elapsed time period N_TCYLLT. The combustion efficiency parameter KLMTCYHBDSN is set to a predetermined value KDL1 (e.g. 0.4) at a time point a second predetermined time period T2 (e.g. 500 msec) has elapsed, and set to a maximum value KDLMAX (e.g. 1.0) larger than the predetermined value KDL1 after the lapse of the second predetermined time period T2. In this table, the combustion efficiency parameter KLMTCYHBDL increases with a smaller gradient than the table value KLMTCYHBDSN for the negative pressure non-request time in the FIG. 10 table. This is because the combustion efficiency is higher in the lean combustion mode than in the stoichiometric combustion mode.

Figure 15:
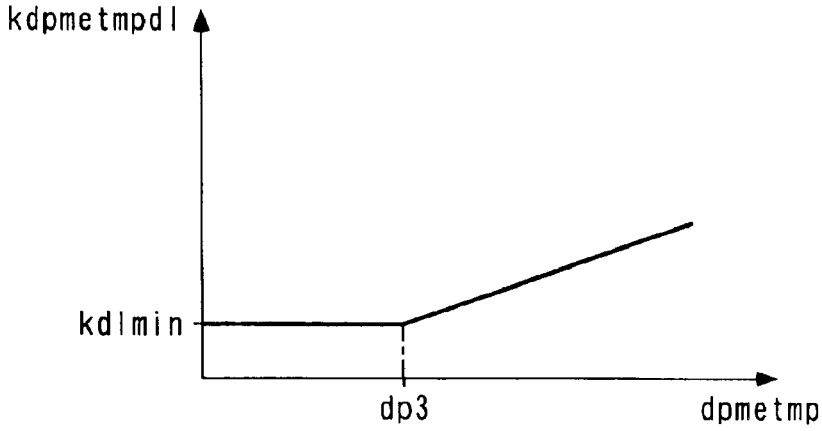
FIG. 15 is a diagram showing an example of dpmetmp-kdpmetmpdl table used in a step 98, in FIG. 13.

Then, similarly to the steps 75 and 76, the torque difference dpmetmp between the demanded torque PMCMDREG and the pre-switching demanded torque PMTCYLIN is calculated (step 96), and then it is determined whether or not dpmetmp>0 holds (step 97). If the answer to this question is affirmative (YES), i.e. if the demanded torque PMCMDREG is larger than the pre-switching demanded torque PMTCYLIN, a correction coefficient kdpmetmpdl for the lean combustion mode is calculated by searching a dpmetmp-kdpmetmpdl table shown in FIG. 15, according to the torque difference dpmetmp (step 98). In this table, the correction coefficient kdpmetmpdl is set to a minimum value kdlmin (e.g. 1.0) when the torque difference dpmetmp is equal to or smaller than a third predetermined value dp3 (e.g. 1.2 kgf/cm$^3$), and set, when the torque difference dpmetmp is larger than the third predetermined value dp3, such that the correction coefficient kdpmetmpdl increases linearly with an increase in the torque difference dpmetmp. In this table, the correction coefficient kdpmetmpdl increases with a smaller gradient than the correction coefficient kdpmetmpds in the FIG. 11 table referred to hereinbefore. This is because the combustion efficiency is higher in the lean combustion mode than in the stoichiometric combustion mode. On the other hand, if the answer to the question of the step 97 is negative (NO), the correction coefficient kdpmetmpdl is set to 1.0 similarly to the step 78 (step 99).

In a step 100 following the step 98 or 99, the combustion efficiency parameter KLMTCYH (first combustion efficiency) is set to a value obtained by multiplying the combustion efficiency coefficient KLMTCYHBDL calculated in the step 95 by the correction coefficient kdpmetmpdl set in the step 98 or 99.

On the other hand, if the answer to the question of the step 94 is affirmative (YES), which means that the combustion mode has been switched from the lean combustion mode to the stoichiometric combustion mode, steps 101 to 108 are executed in quite the same manner as the steps 74 to 79.

Then, the limit value TCYLLT is calculated by the aforementioned equation (2) as in the step 80, using the combustion efficiency parameter KLMTCYH set in the step 100 or 108, and other values (step 109). Subsequently, steps 110 to 113 are executed in quite the same manner as the steps 81 to 84 in FIG. 9, followed by terminating the present program. It should be noted that in the FIG. 14 table, for the same reason as described with reference to the FIG. 10 table, a maximum value KDLMAX is set to a value which ensures that the limit value TCYLLT calculated using the maximum value KDLMAX becomes larger than the normal-time demanded fuel injection time period TCYLTMP when the post-switching elapsed time period N_TCYLLT has exceeded the second predetermined time period T2.

Figure 16:
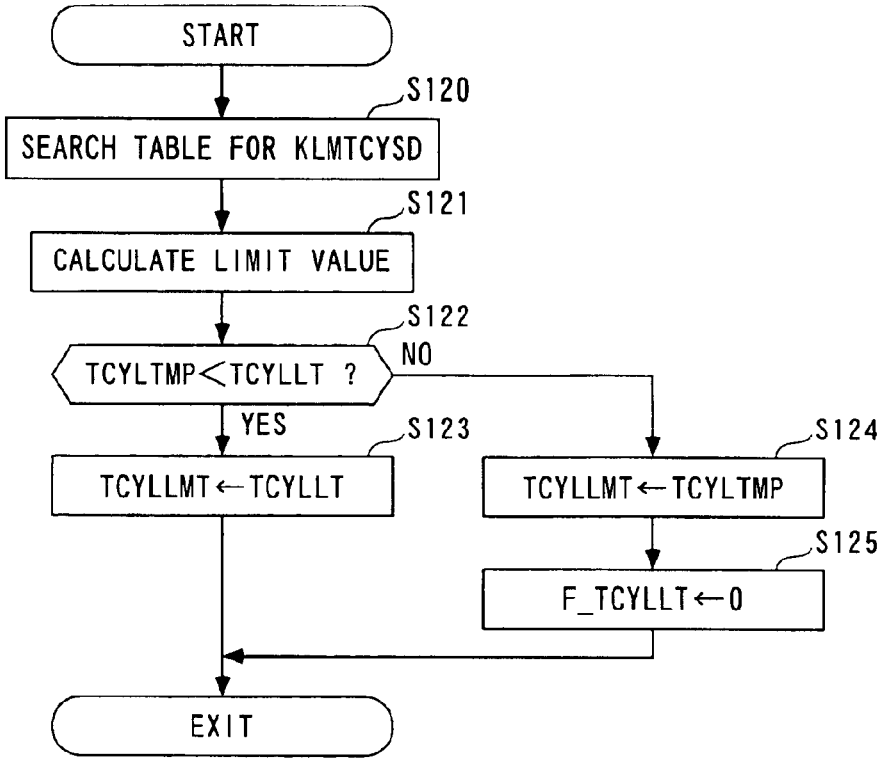
FIG. 16 is a flowchart showing the subroutine of a process for calculating the limit value when the combustion mode is switched from the stoichiometric combustion mode to the stratified combustion mode, which is executed in a step 65 in FIG. 8.

FIG. 16 is a flowchart showing the subroutine of a process executed in the step 65 in FIG. 8 for calculating the limit value TCYLLT for use when the combustion mode is switched from the stoichiometric combustion mode to the stratified combustion mode (for use in a second switching pattern). First, in a step 120, the combustion efficiency parameter KLMTCYSD (second combustion efficiency) to be applied when the combustion mode is switched from the stoichiometric combustion mode to the stratified combustion mode is calculated by searching an N_TCYLLT-KLMTCYSD table shown in FIG. 17, according to the post-switching elapsed time period N_TCYLLT. In this table, for the same reason as described hereinabove with reference to the tables in FIGS. 10 and 11, the combustion efficiency parameter KLMTCYSD is set such that it progressively increases with an increase in the post-switching elapsed time period N_TCYLLT. The combustion efficiency parameter KLMTCYSD is set to a predetermined value KSD1 (e.g. 0.4) at a time point a third predetermined time period T3 (e.g. 800 msec) has elapsed, and set to a maximum value KSDMAX (e.g. 4.0) larger than the predetermined value KSD1 after the lapse of the third predetermined time period T3.

Then, in a step 121, the limit value TCYLLT is calculated, using the pre-switching demanded fuel injection time period TCYLLTIN, the combustion efficiency parameter KLMTCYSD, the demanded torque PMCMDREG and the pre-switching demanded torque PMTCYLIN, by the following equation (3):

$$TCYLLT=TCYLLTIN\cdot(1-KLMTCYSD)\cdot PMCMDREG/PMTCYLIN \quad (3)$$

In the low-load region, the combustion efficiency tends to be higher in the stratified combustion mode than in the homogeneous combustion mode, as described hereinbefore, and hence when the combustion mode is switched from the homogeneous combustion mod to the stratified combustion mode, the combustion efficiency increases. Accordingly, the demanded fuel injection time period TCYLBS required to output the same magnitude of torque tends to decrease. The value (1−KLMTCYSD) corresponds to a degree of increase in the combustion efficiency from a value thereof assumed immediately before the combustion mode has been switched. For this reason, in the above equation (3), the value (1−KLMTCYSD) is used for multiplication, whereby the increase in the combustion efficiency from the value thereof assumed immediately before the switching of the combustion mode is compensated for, thereby setting the limit value TCYLLT to a smaller value than a value calculated without using the value (1−KLMTCYSD).

Then, it is determined whether or not the normal-time demanded fuel injection time period TCYLTMP is smaller than the calculated limit value TCYLLT (step 122). If the answer to the question is affirmative (YES), the switching-time demanded fuel injection time period TCYLLMT is set to the limit value TCYLLT (step 123), followed by terminating the present program.

If the answer to the question is negative (NO), i.e. if TCYLTMP≧TCYLLT holds, the switching-time demanded fuel injection time period TCYLLMT is set to the normal-time demanded fuel injection time period TCYLTMP (step 124). Further, since the limit value TCYLLT is equal to or smaller than the normal-time demanded fuel injection time period TCYLTMP, which means that the limiting operation using the limit value TCYLLT cannot be executed, the limitation permitting flag F_TCYLLT is set to 0 (step 125) so as to terminate the limiting operation, followed by terminating the present program.

Figure 17:
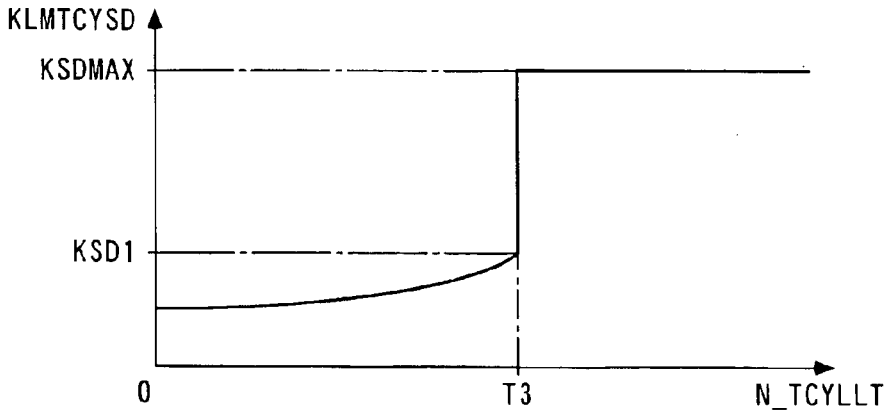
FIG. 17 is a diagram showing an example of an N_TCYLLT-KLMTCYSD table used in a step 120 in FIG. 16.

It should be noted that in the FIG. 17 table, the maximum value KSDMAX is set such that the limit value TCYLLT becomes a negative value at a time point the post-switching elapsed time period N_TCYLLT has exceeded the third predetermined time period T3. In other words, the maximum value KSDMAX is set to a value which ensures that the limit value TCYLLT becomes smaller than the normal-time demanded fuel injection time period TCYLTMP at this time point. Similarly to the cases of the tables shown FIGS. 10 and 14, this setting is required so as to make the answer to the question of the step 122 negative (NO) when the third predetermined time period T3 has elapsed, even if a longer time period than the third predetermined time period T3 was erroneously input as the limit time period NTCYL, thereby positively terminating the limiting operation using the limit value TCYLLT.

Figure 18:
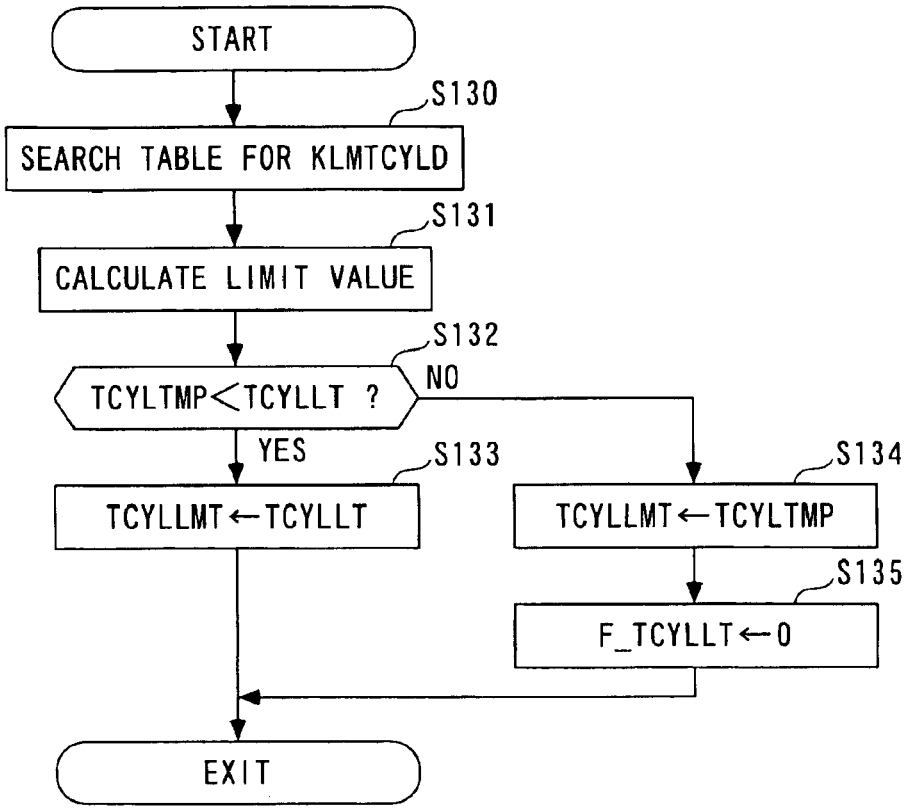
FIG. 18 is a flowchart showing the subroutine of a process for calculating the limit value when the combustion mode is switched from the lean combustion mode to the stratified combustion mode, which is executed in a step 66 in FIG. 8.
Figure 19:
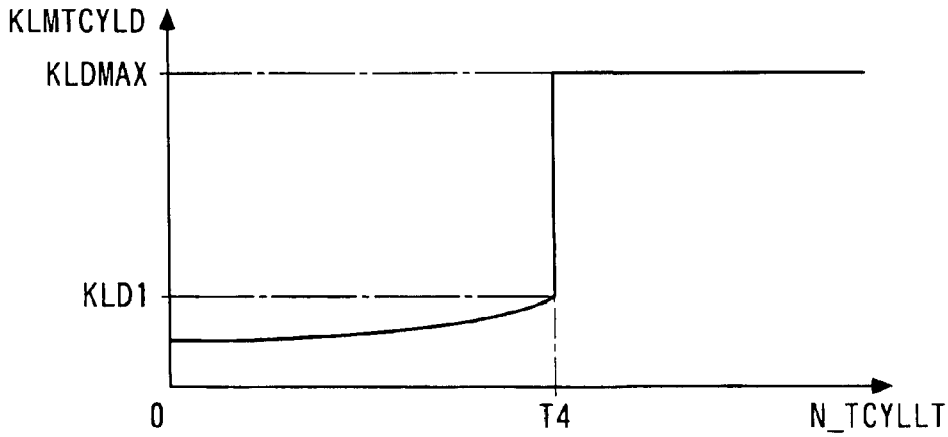
FIG. 19 is a diagram showing an example of an N_TCYLLT-KLMTCYLD table used in a step 130 in FIG. 18.

FIG. 18 is a flowchart showing the subroutine of a process executed in the step 66 in FIG. 8 for calculating the limit value TCYLLT when the combustion mode is switched from the lean combustion mode to the stratified combustion mode (for use in the second switching pattern). First, in a step 130, the combustion efficiency parameter KLMTCYLD (second combustion efficiency) to be applied when the combustion mode is switched from the lean combustion mode to the stratified combustion mode is calculated by searching an N_TCYLLT-KLMTCYLD table shown in FIG. 19, according to the post-switching elapsed time period N_TCYLLT. In this table, similarly to the FIG. 17 table, the combustion efficiency parameter KLMTCYLD is set such that it progressively increases with an increase in the post-switching elapsed time period N_TCYLLT. The combustion efficiency parameter KLMTCYLD is set to a predetermined value KLD1 (e.g. 0.3) at a time point a fourth predetermined time period T4 (e.g. 800 msec) has elapsed, and set to a maximum value KLDMAX (e.g. 4.0) larger than the predetermined value KLD1 after the lapse of the fourth predetermined time period T4. It should be noted that in the present table, the combustion efficiency parameter KLMTCYLD increases with a smaller gradient than the combustion efficiency parameter KLMTCYSD in the FIG. 17 table, and the predetermined value KLD1 is set to a smaller value than the predetermined value KSD1 in the FIG. 17 table. This is because the combustion efficiency is higher in the lean combustion mode than in the stoichiometric combustion mode.

Then, the limit value TCYLLT is calculated (step 131), using the pre-switching demanded fuel injection time period TCYLLTIN, the combustion efficiency parameter KLMTCYLD, the demanded torque PMCMDREG and the pre-switching demanded torque PMTCYLIN, by the following equation (4):

$$TCYLLT=TCYLLTIN\cdot(1-KLMTCYLD)\cdot PMCMDREG/PMTCYLIN \quad (4)$$

It should be noted that in the above equation (4), similarly to the equation (3), the value (1−KLMTCYLD) corresponds to a degree of increase in the combustion efficiency from a value thereof assumed immediately before the combustion mode has been switched. By multiplying this value, the increase in the combustion efficiency from a value thereof assumed immediately before the switching of the combustion mode is compensated for, thereby setting the limit value TCYLLT to a smaller value that a value calculated without using the value (1−KLMTCYLD).

Then, similarly to the steps 122 to 125, steps 132 to 135 are executed, followed by terminating the present program. It should be noted that in the FIG. 19 table, the maximum value KLDMAX is set to a value which ensures that the limit value TCYLLT calculated using the maximum value KLDMAX becomes smaller than the normal-time demanded fuel injection time period TCYLTMP when the post-switching elapsed time period N_TCYLLT has exceeded the fourth predetermined time period T4. This setting is required for the same reason as described with reference to the FIG. 17 table.

As described above, in the present embodiment, when the combustion mode is switched, the limit value TCYLLT is calculated according to the demanded torque PMCDREG by one of the equations (2) to (4). Therefore, differently from the normal-time demanded fuel injection time period TCYLTMP calculated based on the intake pipe absolute pressure PBA as described hereinbefore, the limit value TCYLLT can be set to a value correctly reflecting the actual demanded torque PMCMDREG at the time point without causing sharp changes in the demanded fuel injection time period. Further, since the limit value TCYLLT is calculated based on the pre-switching demanded fuel injection time period TCYLLTIN and the pre-switching demanded torque PMTCYLIN, it is possible to achieve a smooth transition in the combustion mode of the engine 3 without a large torque step between before and after the switching of the combustion mode.

Furthermore, since the limit value TCYLLT is calculated according to the combustion efficiency parameter KLMTCYH, KLMTCYSD or KLMTCYLD, it is possible to set the limit value TCYLLT to an appropriate value dependent on the actual combustion efficiency at the time. Thus, the output torque of the engine 3 can be excellently matched with the demanded torque, which makes it possible to enhance the drivability.

Moreover, since the combustion efficiency parameter KLMTCYH is corrected according to the torque difference dpmetmp by executing the steps 76, 77, 79, 97, 98 and 100, it is possible to set the limit value TCYLLT to a value exactly reflecting an overall increasing tendency of the demanded torque PMCMDREG up to the present time, with respect to a value thereof assumed before the switching of the combustion mode, and hence cause the output torque of the engine 3 to more exactly match a torque demanded by the driver.

Further, by execution of the step 13 in FIG. 4, the calculation of the limit value TCYLLT is inhibited after the termination of the F/C operation until a time period corresponding to the predetermined value #CTCYLD elapses, whereby the normal-time demanded fuel injection time period TCYLTMP is used as the demanded fuel injection time period TCYLBS. This makes it possible to set the demanded fuel injection time period TCYLBS to an appropriate value dependent on operating conditions of the engine without setting the same to a value of 0, and hence a sufficient torque can be obtained from the engine 3 as a whole.

Further, when the combustion mode is switched from the stratified combustion mode to the homogeneous combustion mode, there is employed, as a parameter for calculating the limit value TCYLLT, a value calculated by adding the combustion efficiency parameter KLMTCYH to a value of 1, by the equation (2), and when the combustion mode is switched in an opposite direction to the above, there is employed, as the same parameter, a value calculated by subtracting the combustion efficiency parameter KLMTCYSD from a value of 1, by the equation (3), or a value calculated by subtracting the combustion efficiency parameter KLMTCYLD from a value of 1 by the equation (4). This makes it possible to set the limit value TCYLLT to an optimal value dependent on the actual combustion efficiency at the time in whichever of the switching patterns the combustion mode may be switched. Thus, when the combustion mode is switched, it is possible to cause the output toque of the engine to excellently match the demanded torque in whichever of the switching patterns the combustion mode may be switched, thereby enhancing drivability.

It should be noted that the present invention is not necessarily limited to the embodiment described above, but can be practiced in various forms. For example, although in the present embodiment, the combustion efficiency parameter KLMTCYH is corrected according to the torque difference dpmetmp only when the combustion mode is switched to the homogeneous combustion mode, this is not limitative, but when the combustion mode is switched to the stratified combustion mode, the combustion efficiency parameter KLMTCYSD or KLMTCYLD may be corrected according to the torque difference dpmetmp. More specifically, when the torque difference dpmetmp assumes a negative value, i.e. when the demanded torque PMCMDREG in the current loop is smaller than the pre-switching request torque PMTCYLIN, the combustion efficiency parameter KLMTCYSD or KLMTCYLD may be corrected to a larger value. This makes it possible, even when the combustion mode is switched to the stratified combustion mode in which the demanded torque PMCMDREG tends to decrease, to set the limit value TCYLLT to a value exactly reflecting an overall decreasing tendency of the demanded torque PMCMDREG up to the present time, with respect to a value thereof assumed immediately before the switching of the combustion mode, and hence cause the output torque of the engine 3 to more exactly match a torque demanded by the driver.

Although in the above described embodiment, the present invention is applied to the engine 3 for a vehicle, this is not limitative, but the present invention can be applied to a ship propulsion engine, including an outboard motor which has a vertically-disposed crankshaft.

It is further understood by those skilled in the art that the foregoing is a preferred embodiment of the invention, and that various changes and modification may be made without departing from the spirit and scope thereof.

What is claimed is:

1. A control system for an internal combustion engine of an in-cylinder injection type, which causes the engine to operate while switching a combustion mode thereof between a stratified combustion mode in which stratified combustion of a mixture is carried out and a homogeneous combustion mode in which homogenous combustion of the mixture is carried out, and at the same time controls a fuel injection amount based on a demanded fuel amount which is calculated, the control system comprising:

operating condition-detecting means for detecting operating conditions of the engine;

demanded fuel amount-calculating means for calculating the demanded fuel amount according to the detected operating conditions of the engine;

demanded torque-calculating means for calculating a demanded torque of the engine according to the detected operating conditions of the engine;

combustion mode-determining means for determining which of the stratified combustion mode and the homogeneous combustion mode should be selected as the combustion mode, according to the calculated demanded torque;

storage means for storing the demanded fuel amount and the demanded torque both calculated immediately before the combustion mode has been switched according to the determination by said combustion mode-determining means;

combustion efficiency-estimating means for estimating combustion efficiency of the engine; and switching-time demanded fuel amount-calculating means responsive to switching of the combustion mode, for calculating a switching-time demanded fuel amount, as the demanded fuel amount, according to the stored demanded fuel amount and demanded torque, the demanded torque currently calculated by said demanded torque-calculating means, and the combustion efficiency currently estimated by said combustion efficiency-estimating means.

2. A control system for an internal combustion engine of an in-cylinder injection type, which causes the engine to operate while switching a combustion mode thereof between a stratified combustion mode in which stratified combustion of a mixture is carried out and a homogeneous combustion mode in which homogenous combustion of the mixture is carried out, and at the same time controls a fuel injection amount based on a demanded fuel amount which is calculated, the control system comprising:

operating condition-detecting means for detecting operating conditions of the engine;

demanded fuel amount-calculating means for calculating the demanded fuel amount according to the detected operating conditions of the engine;

demanded torque-calculating means for calculating a demanded torque of the engine according to the detected operating conditions of the engine;

combustion mode-determining means for determining which of the stratified combustion mode and the homogeneous combustion mode should be selected as the combustion mode, according to the calculated demanded torque;

storage means for storing the demanded fuel amount and the demanded torque both calculated immediately before the combustion mode has been switched according to the determination by said combustion mode-determining means;

first combustion efficiency-estimating means for estimating a first combustion efficiency of the engine for use in a first switching pattern in which the combustion mode is switched from the stratified combustion mode to the homogeneous combustion mode;

second combustion efficiency-estimating means for estimating a second combustion efficiency of the engine for use in a second switching pattern in which the combustion mode is switched from the homogeneous combustion mode to the stratified combustion mode; and switching-time demanded fuel amount-calculating means responsive to switching of the combustion mode, for calculating a switching-time demanded fuel amount, as the demanded fuel amount, according to the stored demanded fuel amount and demanded torque, the demanded torque currently calculated by said demanded torque-calculating means, and one of the first combustion efficiency and the second combustion efficiency corresponding to one of the first switching pattern and the second switching pattern according to which the switching of the combustion mode has been currently performed.

3. A control method for an internal combustion engine of an in-cylinder injection type, which causes the engine to operate while switching a combustion mode thereof between a stratified combustion mode in which stratified combustion of a mixture is carried out and a homogeneous combustion mode in which homogenous combustion of the mixture is carried out, and at the same time controls a fuel injection amount based on a demanded fuel amount which is calculated, the control method comprising:

an operating condition-detecting step of detecting operating conditions of the engine;

a demanded fuel amount-calculating step of calculating the demanded fuel amount according to the detected operating conditions of the engine;

a demanded torque-calculating step of calculating a demanded torque of the engine according to the detected operating conditions of the engine;

a combustion mode-determining step of determining which of the stratified combustion mode and the homogeneous combustion mode should be selected as the combustion mode, according to the calculated demanded torque;

a storing step of storing the demanded fuel amount and the demanded torque both calculated immediately before the combustion mode has been switched according to the determination in said combustion mode-determining step;

a combustion efficiency-estimating step of estimating combustion efficiency of the engine; and a switching-time demanded fuel amount-calculating step of calculating a switching-time demanded fuel amount upon switching of the combustion mode, as the demanded fuel amount, according to the stored demanded fuel amount and demanded torque, the demanded torque currently calculated in said demanded torque-calculating step, and the combustion efficiency currently estimated in said combustion efficiency-estimating step.

4. A control method for an internal combustion engine of an in-cylinder injection type, which causes the engine to operate while switching a combustion mode thereof between a stratified combustion mode in which stratified combustion of a mixture is carried out and a homogeneous combustion mode in which homogenous combustion of the mixture is carried out, and at the same time controls a fuel injection amount based on a demanded fuel amount which is calculated, the control method comprising:

an operating condition-detecting step of detecting operating conditions of the engine;

a demanded fuel amount-calculating step of calculating the demanded fuel amount according to the detected operating conditions of the engine;

a demanded torque-calculating step of calculating a demanded torque of the engine according to the detected operating conditions of the engine;

a combustion mode-determining step of determining which of the stratified combustion mode and the homogeneous combustion mode should be selected as the combustion mode, according to the calculated demanded torque;

a storing step of storing the demanded fuel amount and the demanded torque both calculated immediately before the combustion mode has been switched according to the determination in said combustion mode-determining step;

a first combustion efficiency-estimating step of estimating a first combustion efficiency of the engine for use in a first switching pattern in which the combustion mode is switched from the stratified combustion mode to the homogeneous combustion mode;

a second combustion efficiency-estimating step of estimating a second combustion efficiency of the engine for use in a second switching pattern in which the combustion mode is switched from the homogeneous combustion mode to the stratified combustion mode; and a switching-time demanded fuel amount-calculating step of calculating a switching-time demanded fuel amount upon switching of the combustion mode, as the demanded fuel amount, according to the stored demanded fuel amount and demanded torque, the demanded torque currently calculated in said demanded torque-calculating step, and one of the first combustion efficiency and the second combustion efficiency corresponding to one of the first switching pattern and the second switching pattern according to which the switching of the combustion mode has been currently performed.

* * * * *